US007650665B2

(12) United States Patent
Morris et al.

(10) Patent No.: US 7,650,665 B2
(45) Date of Patent: Jan. 26, 2010

(54) MOP ASSEMBLY WITH FASTENER CHANNELS

(75) Inventors: Cameron Ray Morris, Cumming, GA (US); Stephanie Ann Rossignol, Cumming, GA (US); George Nukuto, Neenah, WI (US); Denis R. Grimard, Appleton, WI (US); Carl G. Rippl, Appleton, WI (US); MeeWha Lee, Appleton, WI (US); Paul Woon, Alpharetta, GA (US); Russell J. Kroll, Atlanta, GA (US); Mark Londborg, Atlanta, GA (US); Robert Henshaw, Newnan, GA (US); Kiran K. Reddy, Roswell, GA (US); Thomas Glenn Merrill, Cumming, GA (US); Jose Ricardo Rubio-Flores, Jr., Roswell, GA (US)

(73) Assignee: Kimberly-Clark Worlwide, Inc., Neenah, WI (US)

( * ) Notice: Subject to any disclaimer, the term of this patent is extended or adjusted under 35 U.S.C. 154(b) by 77 days.

(21) Appl. No.: 11/458,106

(22) Filed: Jul. 18, 2006

(65) Prior Publication Data

US 2008/0016635 A1 Jan. 24, 2008

(51) Int. Cl.
*A47L 13/20* (2006.01)
*A47L 13/24* (2006.01)

(52) U.S. Cl. ..... 15/231; 15/228; 15/147.1; 15/144.2; 15/145

(58) Field of Classification Search ..... 15/231–233, 15/150, 228, 144.1, 143.1, 104.94, 147.1, 15/147.2
See application file for complete search history.

(56) References Cited

U.S. PATENT DOCUMENTS 1,605,008 A 11/1926 Smith (Continued)

FOREIGN PATENT DOCUMENTS

DE 19908259 A1 8/2000

(Continued)

OTHER PUBLICATIONS

Patent Abstracts of Japan, JP 08228985 A, Sep. 10, 1996.

(Continued)

*Primary Examiner*—Gary K Graham
(74) *Attorney, Agent, or Firm*—Nathan P. Hendon

(57) ABSTRACT

A mop head assembly for use with a handle and a cleaning substrate is disclosed. The mop head assembly includes a lower substrate support surface, at least one fastener channel associated with the lower substrate support surface, and a fastener strip that can be inserted into the fastener channel. Such a fastener strip is configured to couple the lower substrate support surface to a cleaning substrate. The mop head assembly may include a cross-member configured such that forces applied from the handle through a central portion of mop head are distributed toward the end edges of the lower substrate support surface.

23 Claims, 11 Drawing Sheets

U.S. PATENT DOCUMENTS 1,609,414 A 12/1926 Lenny
1,872,589 A * 8/1932 Hoff ..... 15/244.1
2,328,287 A 8/1943 Martin
2,900,652 A 8/1959 Kautenberg
3,203,029 A 8/1965 Serio
3,208,318 A 9/1965 Roberts
3,221,356 A 12/1965 Schimer
3,395,415 A 8/1968 Leland
3,605,161 A 9/1971 Moss et al.
3,692,618 A 9/1972 Dorschner et al.
3,737,938 A 6/1973 Saltzstein
3,778,860 A 12/1973 Thielen
3,792,505 A 2/1974 Saltzstein
3,837,031 A * 9/1974 Allaire et al. ..... 15/150
3,849,241 A 11/1974 Butin et al.
3,850,533 A 11/1974 Thielen
3,996,639 A 12/1976 Griffin et al.
4,041,203 A 8/1977 Brock et al.
4,114,223 A 9/1978 Buchanan
4,225,998 A 10/1980 Thielen
4,247,216 A * 1/1981 Pansini ..... 403/109.3
4,340,563 A 7/1982 Appel et al.
4,353,142 A 10/1982 Nishiyama et al.
4,433,931 A 2/1984 Malish et al.
4,685,167 A 8/1987 Murray
4,763,377 A 8/1988 Madsen
4,819,293 A 4/1989 Nicholson
4,852,210 A 8/1989 Krajicek
4,962,682 A 10/1990 Rose et al.
5,071,489 A 12/1991 Silvenis et al.
5,145,727 A 9/1992 Potts et al.
5,169,706 A 12/1992 Collier, IV et al.
5,178,931 A 1/1993 Perkins et al.
5,188,885 A 2/1993 Timmons et al.
5,207,754 A 5/1993 Harrah
5,253,387 A 10/1993 Kresse et al.
5,288,161 A 2/1994 Graves et al.
D348,827 S 7/1994 Berti et al.
5,343,587 A * 9/1994 Findley ..... 15/228
5,375,286 A 12/1994 Harrah
5,379,478 A 1/1995 Vosbikian
5,394,594 A * 3/1995 Duran ..... 24/453
5,402,559 A 4/1995 Allison et al.
5,419,015 A 5/1995 Garcia
5,442,830 A 8/1995 Ohm
5,455,980 A 10/1995 Buchanan
5,461,749 A * 10/1995 Ahlberg et al. ..... 15/228
D366,740 S 1/1996 Clausen et al.
5,581,839 A 12/1996 Ferrell, Jr.
5,701,628 A 12/1997 Morad
5,740,578 A 4/1998 Moore
D398,724 S 9/1998 Kohlruss et al.
5,842,810 A 12/1998 Morad
5,876,141 A 3/1999 Hsu
5,901,402 A 5/1999 Williams
5,911,258 A 6/1999 Morad
5,920,944 A 7/1999 Biggs et al.
5,937,471 A 8/1999 Liao
6,023,812 A 2/2000 Morad
6,061,864 A * 5/2000 Ensson ..... 15/147.1
6,119,298 A * 9/2000 Kenmochi ..... 15/231
6,212,917 B1 4/2001 Rathbun
6,237,182 B1 5/2001 Cassar
6,298,517 B1 * 10/2001 McKay ..... 15/228
6,305,046 B1 10/2001 Kingry et al.
6,332,234 B1 * 12/2001 Graham et al. ..... 15/228
D458,722 S 6/2002 Romero et al.
D461,028 S 7/2002 Ng
D461,029 S 7/2002 Ng
D464,181 S 10/2002 Ng
6,463,634 B1 10/2002 Naohara et al.
D465,890 S 11/2002 Rivera et al.
6,484,346 B2 * 11/2002 Kingry et al. ..... 15/231
6,513,199 B1 2/2003 Cheng
6,654,980 B2 12/2003 Biggs
6,684,446 B2 2/2004 Salmon
6,736,034 B1 5/2004 Gonzales
6,745,427 B1 * 6/2004 Trenz et al. ..... 15/104.94
6,804,853 B2 10/2004 Wang
6,810,554 B2 11/2004 McKay
6,820,301 B2 11/2004 Petner
6,842,936 B2 1/2005 Policicchio et al.
6,854,919 B2 2/2005 Neumann et al.
6,871,372 B2 * 3/2005 Vosbikian et al. ..... 15/115
6,889,917 B2 5/2005 Fahy et al.
6,925,686 B2 8/2005 Heathcock et al.
6,953,299 B2 10/2005 Wang et al.
6,976,282 B2 12/2005 Sie
6,986,618 B2 1/2006 Hall et al.
7,065,825 B2 6/2006 Minkler et al.
2001/0009632 A1 7/2001 Cross
2002/0042962 A1 * 4/2002 Willman et al. ..... 15/208
2003/0009839 A1 1/2003 Streutker et al.
2003/0028988 A1 2/2003 Streutker et al.
2003/0084531 A1 5/2003 Dingert et al.
2003/0097725 A1 5/2003 Smith
2003/0110584 A1 6/2003 Clare et al.
2004/0068817 A1 4/2004 Policicchio
2004/0074520 A1 4/2004 Truong et al.
2004/0088808 A1 5/2004 Vitantonio et al.
2004/0182952 A1 9/2004 Soller et al.
2004/0188539 A1 9/2004 Soller et al.
2004/0244131 A1 12/2004 Cassar
2004/0244133 A1 12/2004 Li
2004/0255418 A1 12/2004 Minkler et al.
2005/0011536 A1 1/2005 Hofte et al.
2005/0060827 A1 3/2005 James et al.
2005/0066465 A1 3/2005 Minkler et al.
2005/0097691 A1 5/2005 Tsuchiya et al.
2005/0102781 A1 5/2005 Tsuchiya et al.
2005/0251941 A1 11/2005 Berhoff
2005/0251943 A1 11/2005 VanLandingham, Jr.
2005/0265769 A1 12/2005 Blom
2005/0283933 A1 12/2005 Mitchell et al.
2005/0285387 A1 12/2005 Suda et al.
2006/0000041 A1 1/2006 Streutker et al.
2006/0003912 A1 1/2006 Lindsay et al.
2006/0048327 A1 3/2006 Lacotta et al.
2006/0075587 A1 4/2006 Broman
2006/0191557 A1 8/2006 Rosenzweig et al.

FOREIGN PATENT DOCUMENTS

DE 10003899 9/2001
EP 0697269 A2 2/1996
EP 0980667 A2 2/2000
EP 0811350 B1 11/2000
EP 0966222 B1 9/2003
EP 1591053 A1 11/2005
FR 797405 4/1936
FR 2575058 A 6/1986
GB 2259474 3/1993
JP 9131288 5/1997
JP 2002000531 1/2002
WO WO 88/01845 3/1988
WO WO 99/49755 A1 10/1999
WO WO 99/60913 12/1999
WO WO 03/039321 5/2003
WO WO 2004/071266 8/2004
WO WO 2005/084516 9/2005

WO WO 2006/002653 1/2006

OTHER PUBLICATIONS

Patent Abstracts of Japan, JP 10276953 A, Oct. 20, 1998.
Patent Abstracts of Japan, JP 2001309881 A, Nov. 6, 2001.
Patent Abstracts of Japan, JP 2002102132 A, Apr. 9, 2002.
Lawrence, K.D. et al., "An Improved Device for the Formation of Super-Fine Thermoplastic Fibers," *NRL Report 5265*, Feb. 11, 1959.
Wendt, B.A. et al., "Manufacture of Superfine Organic Fibers", *NRL Report 4364*, May 25, 1954.

* cited by examiner

MOP ASSEMBLY WITH FASTENER CHANNELS

BACKGROUND

Various versions of floor mops are commonly available for the variety of cleaning needs in both commercial and domestic consumer environments. For example, cotton string floor dust mops are commonly seen cleaning the dust and debris from school and public building hallways. One problem with such cotton string dust mops is that the dirt and debris can build up in the cotton substrate. Such mop heads need to be regularly cleaned or replaced. Cleaning or replacing the substrate can be cumbersome and may result in significant added cost to the user.

Smaller versions of such dust mops are readily available for consumer home use and utilize disposable cleaning substrates that are applied to the mop head. The disposable cleaning substrate is most commonly wrapped across the floor-contacting surface of such mop heads and both of the substrate's free ends are fastened to the upper surface of the mop head. Various methods have been used to fasten such substrates to these mop heads including ties, clamps, teeth, screws, and other fasteners.

In the case of mops using a disposable sponge substrate, the sponge substrate is often held on the mop head by a clamp, a retention bar, a screw, or some other similar fastening mechanism. In one case a cooperative fastener has included on the surface of the sponge and was configured to attach to a fastener on the mop head.

The problem with any type of fastener used on such mop heads to couple the cleaning substrate to the mop head is that the fastener often wears out, breaks, or becomes fouled with prolonged use. Once the fastener mechanism wears out, breaks or becomes too fouled to be use, the user is forced to purchase a new mop.

Additionally, the particular fastener used with a particular mop head is often designed for a very specific cleaning substrate and consequently does not fasten other cleaning substrates with the same success, if it can fasten the other cleaning substrate at all. Consequently, most available mop heads that utilize a disposable cleaning substrate require a different mop head be obtained if the user wishes to utilize a different disposable cleaning substrate. This results in increased costs to the user and the user having a collection of mops if they desire to use different cleaning substrates.

Finally, most mops that use a disposable cleaning substrate fasten the cleaning substrate to the mop head in such a way that a portion of the cleaning substrate is used in the fastener and become available for use in cleaning. Such a use of a portion of the cleaning substrate is an inefficient use of such a cleaning substrate.

Other problems common with most consumer dry dust or wet mops are related to the design of the mop head. Generally, the handle of such mops are connected at the center of the upper surface of such mop heads. The forces that user applied to the mop head, through the handle, are focused to this connection point; less force is translated to the peripheral edges of the mop head. This problem become exaggerated with larger or more flexible mop heads.

Additionally, the design of most available consumer dry and wet mops using a disposable cleaning substrate have a flat bottom surface that the substrate is held against. The flat surface ensures a high degree of contact of the cleaning substrate with the surface to be cleaned. However, such a design results in more dust and debris being collected along the front edge of the substrate rather than utilizing the entire substrate surface. As the edges become more soiled the substrate has to be replaced before the central portion of the substrate have been used. Another inefficient use of such a disposable cleaning substrate.

Definitions

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "couple" includes, but is not limited to, joining, connecting, fastening, linking, or associating two things integrally or interstitially together.

As used herein, the term "configure(s)", "configured" or "configuration(s)" means to design, arrange, set up, or shape with a view to specific applications or uses. For example: a military vehicle that was configured for rough terrain; configured the computer by setting the system's parameters. As used here, the term "operable" or "operably" means being in a configuration such that use or operation is possible. Similarly, "operably connect(s)" or "operably connected" refers to the relation of elements being so configured that a use or an operation is possible through their cooperation. For example: the machine is operable; the wheel is operably connected to the axle.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "substantially" refers to something which is done to a great extent or degree; for example, "substantially covered" means that a thing is at least 95% covered.

As used herein, the term "alignment" refers to the spatial property possessed by an arrangement or position of things in a straight line or in parallel lines.

As user herein, the terms "orientation" or "position" used interchangeably herein refer to the spatial property of a place where or way in which something is situated; for example, "the position of the hands on the clock."

As used herein the terms "nonwoven fabric", "nonwoven material", or "nonwoven web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter ($g/m^2$ or gsm) and the fiber diameters useful are usually expressed in microns. (Note that to convert from osy to gsm, multiply osy by 33.91).

As used herein, the term "spunbond", "spunbonded", and "spunbonded filaments" refers to small diameter continuous filaments which are formed by extruding a molten thermoplastic material as filaments from a plurality of fine, usually circular, capillaries of a spinnerette with the diameter of the extruded filaments then being rapidly reduced as by, for example, eductive drawing and/or other well-known spunbonding mechanisms. The production of spunbonded nonwoven webs is illustrated in patents such as, for example, in U.S. Pat. No. 4,340,563 to Appel et al., and U.S. Pat. No. 3,692,618 to Dorschner et al. The disclosures of these patents are hereby incorporated by reference.

As used herein the term "meltblown" means fibers formed by extruding a molten thermoplastic material through a plurality of fine, usually circular die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, in various patents and publications, including NRL Report 4364, "Manufacture of Super-Fine Organic Fibers" by B. A. Wendt, E. L. Boone and D. D. Fluharty; NRL Report 5265, "An Improved Device For The Formation of Super-Fine Thermoplastic Fibers" by K. D. Lawrence, R. T. Lukas, J. A. Young; and U.S. Pat. No. 3,849,241, issued Nov. 19, 1974, to Butin, et al. As used herein "multilayer laminate" means a laminate wherein one or more of the layers may be spunbond and/or meltblown such as a spunbond/meltblown/spunbond (SMS) laminate and others as disclosed in U.S. Pat. No. 4,041,203 to Brock et al., U.S. Pat. No. 5,169,706 to Collier, et al, U.S. Pat. No. 5,145,727 to Potts et al., U.S. Pat. No. 5,178,931 to Perkins et al. and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.40 to about 3 osy. Multilayer laminates for many applications also have one or more film layers which may take many different configurations and may include other materials like foams, tissues, woven or knitted webs and the like.

These terms may be defined with additional language in the remaining portions of the specification.

SUMMARY OF THE INVENTION

In light of the problems and issues discussed above, it is desired to have a disposable substrate mop that can accommodate different fasteners and easily replace those fasteners when worn, to accommodate different substrates, and increase the longevity of the substrate mop. It is also desired that the mop head design effectively distributes forces applied to mop head through a mop handle. Finally, it is also desired that the area of unused cleaning substrate be minimized and the usage of the entire cleaning substrate be maximized.

The present invention is directed to a mop head assembly for use with a handle and a cleaning substrate. The mop head assembly includes a lower substrate support surface, at least one fastener channel associated with the lower substrate support surface, and a fastener strip that can be inserted into to fastener channel. Such a fastener strip is configured to couple the lower substrate support surface to a cleaning substrate.

In various embodiments, more than one fastener channel may be present on the lower substrate support surface, the assembly may include more than one fastener strip, multiple fastener strips may be present in the same fastener channel, and more than one type of fastener strip may be used. In other various embodiments, the lower substrate support surface is convexly curved, an end cap is releaseably attached to the end of the lower substrate support surface, and the end cap may include an brush, scrubbing tool, or rounded shape.

In other embodiments, the assembly may include an upper surface. That upper surface may additionally include a secondary substrate attachment point. Such a secondary attachment point may be a fastener channel and fastener strip.

In some embodiments, the assembly may include a mop handle releaseably engaged with a socket mount on the mop head assembly. The mop handle may be a quick-release handle including a proximal end proximate to the mop head and a distal end distal to the mop head; a quick-release coupling assembly positioned on the proximate end of the handle, the quick-release coupling assembly configured to releaseably couple the handle to the head mount; and a button actuator positioned on the distal end of the handle, the button actuator operably connected to the quick-release coupling assembly. Additionally, in various embodiments, the handle may additionally include a coupler shroud that cooperatively couples with the head mount, the button actuator may be recessed within the end of the shaft, and the handle may include an ergonomic, freely-rotating knob.

The present invention is also directed to a mop head assembly as described above, but also including a cross-member associated with the lower substrate support surface. The cross-member extending between the opposing end edges of the lower substrate support surface and where the cross-member is configured such that forces applied to a central portion of the cross-member are distributed along the cross-member toward the end edges of the lower substrate support surface.

The present invention is also directed to a mop system including the mop head assembly and a disposable cleaning substrate coupled to the mop head assembly by at least one fastener strip within at least one fastener channel of the mop head assembly. In some embodiments, the system may also include a quick-release handle coupled to the mop head assembly. In other embodiments, the disposable cleaning substrate may be a continuous web of cleaning substrate.

In some embodiments, the system may include a plurality of fastener strips. That plurality of fastener strips may include a variety of different types of fastener strips and may include an indicia. Additionally the system may include a variety of different types of cleaning substrates which may include an indicia.

Finally, the present invention is also directed to a method of providing a cleaning system. The method includes providing a mop head assembly, a plurality of cleaning substrates including different types of cleaning substrates, providing a plurality of fastener strips including different types of fastener strips that work with the different types of cleaning substrates, and providing instruction to the user to assist them in selecting the proper fastener strip and cleaning substrate appropriate for their particular cleaning needs.

DETAILED DESCRIPTION

Figure 1:
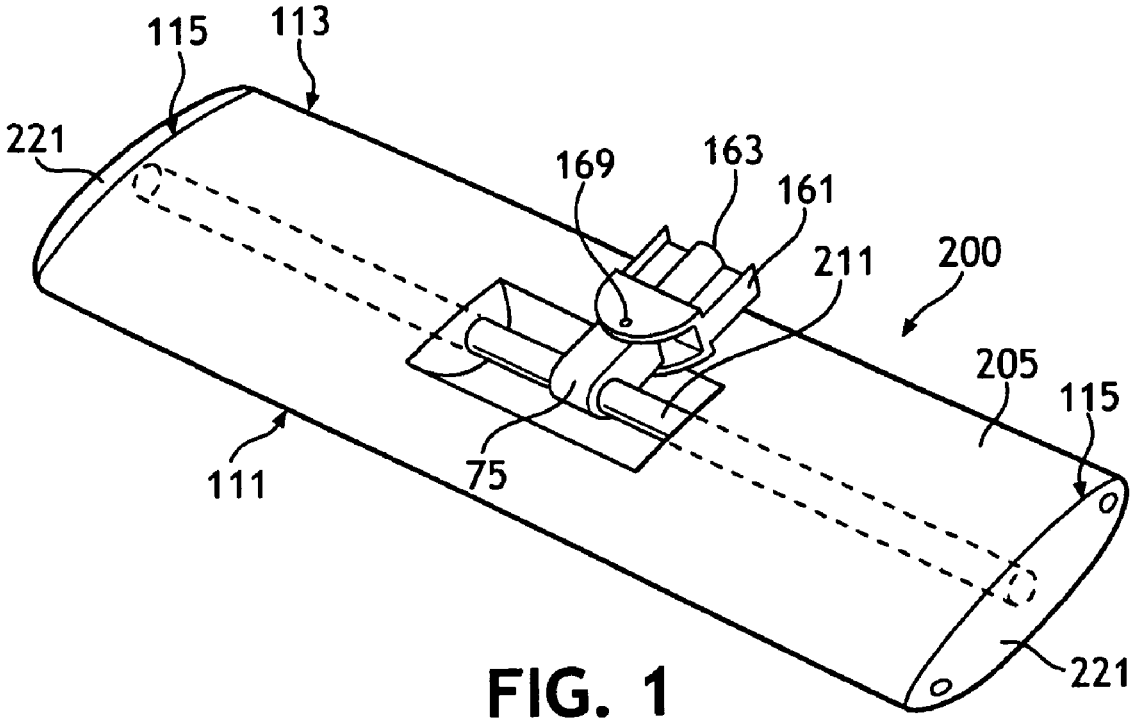
FIG. 1 is a perspective view of a mop head of the present invention.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to FIGS. 1-8C in general, the mop head 200 of the present invention includes a lower substrate support surface 203 to which a disposable cleansing substrate may be coupled during use of the mop head 200. One or more fastener channels 171 may be associated with the lower substrate support surface 203 and may be configured to contain one or more fastener strips 181. Such fastener strips 181 may be configured to couple the lower substrate support surface 203 to the disposable cleansing substrate.

As shown in FIG. 1, the mop head 200 may also include a cross-member 211. The cross-member 211 spans the width of the mop head 200, from one end edge 115 to the opposite end edge 115. Also, the cross-member 211 would desirably be centrally positioned between, and runs generally parallel to, the front edge 111 and the back edge 113 of the mop head 200.

The cross-member 211 is configured with the mop head 200 to bring all of the elements of the mop into cooperation. A head mount 161 may be coupled to the cross-member at a central position on the cross-member 211 between the opposed end edges 115; the head mount 161 configured to releaseably couple the mop head 200 with a handle. The cross-member 211 is intended to be coupled to the mop head 200 in such a way that the cross-member 211 is in working communication with the lower substrate support surface 203.

Figure 7:
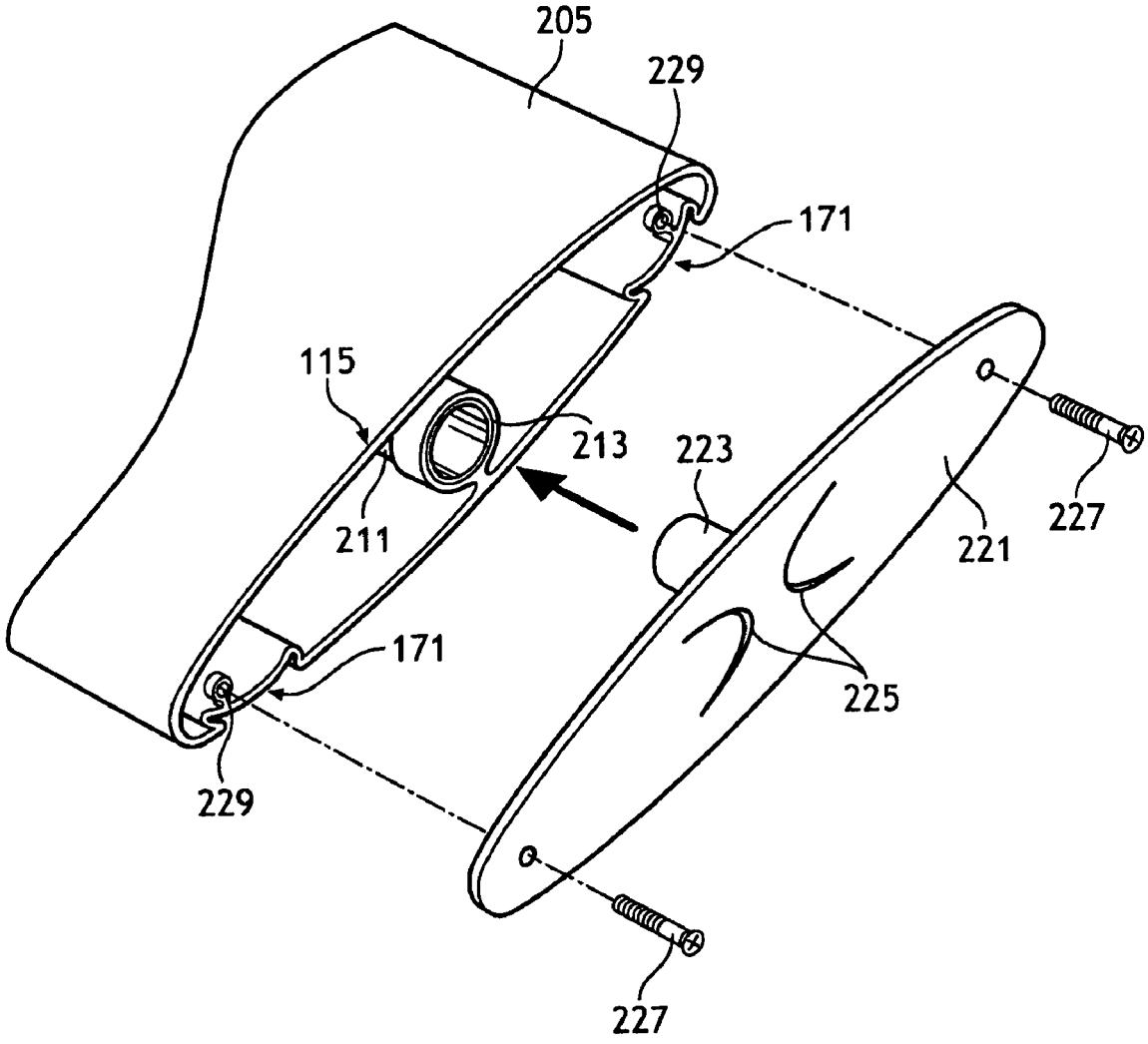
FIG. 7 is a partial perspective exploded view of an end cap of the mop head of FIG. 1.

For example, the cross-member 211 partially illustrated in FIG. 7 is secured to the end edge 115 of the lower substrate support surface 203 by a cross-member collar 213. One or more of such collars 213 may be included along the width mop head 200 to better couple the cross-member 211 to the lower substrate support surface 203. The configuration illustrated in FIG. 7 is only one possible configuration of how the cross-member 211 may be coupled to the mop head 200; the cross-member 211 may be coupled to the mop head 200 by any means or fashion that the cross-member 211 is working communication with the lower substrate support surface 203.

Figure 5:
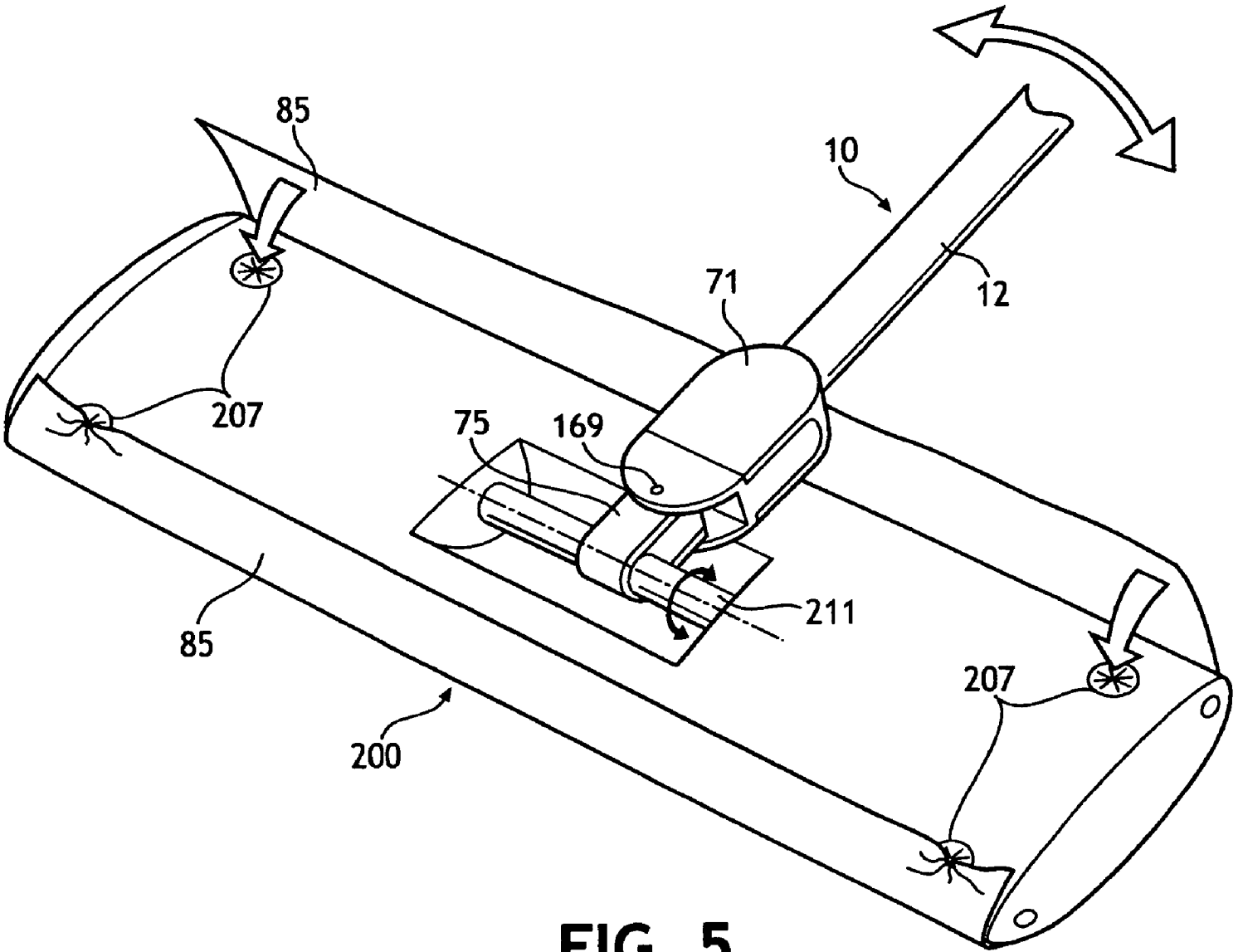
FIG. 5 is a partial perspective view of the mop head of FIG. 1 shown coupled with a quick-release handle and illustrating a disposable cleaning substrate being coupled to the mop head, the disposable cleaning substrate shown being wrapped across the lower substrate support surface and using secondary attachment structures on the upper surface of the mop head to assist in securing the cleaning substrate.

In use, the mop head 200 may be coupled with a handle 10 and a disposable cleaning substrate 83, as illustrated in FIG. 5. When the user pushes on the handle 10 to clean a surface with the attached mop head 200, the forces applied to the handle 10 are communicated through the head mount 161, through the cross-member 211, and across the width of the lower substrate support surface 203. By translating the forces applied to the centrally located handle 10 to the entire width of the lower substrate support surface 203 of the mop head 200, the user is able to apply pressure across the entire width of the mop head 200. Resultantly, the user may make better use the entire lower substrate surface 203 to clean the floor, or other surface the mop is being used to clean.

The cross-member 211 is preferably hollow to better couple with end caps 221 having a cross-member plug 223 (see FIG. 7) and to decrease the weight of the mop head 200. The thickness of the hollow cross-member 211 is a function of the materials used to make the cross-member 211, the inside diameter required to accommodate a particular cross-member plug 223, and the strength and weight desired. One skilled in the art would see how such variables could be balanced to produce the cross-member 211.

The cross-member 211 may be made from any material that meets the needs of the particular mop head 200. For example, a stronger cross-member 211 may be desired for commercial applications while a lighter cross-member 211 may be desired for home applications. Other considerations may include, but are not limited to, weight, durability, compatibility with chemicals and substances the mop head 200 may come in contact, appearance, ease of cleaning, colors available, disposability, and the like. Typically, the cross-member may be made of a metal, plastic, or wood. More particularly, the cross-member 211 may be made of aluminum, stainless steel, ABS-plastic, or the like. Again, one skilled in the art would see how such variables could be balanced to produce the cross-member 211.

Figure 2:
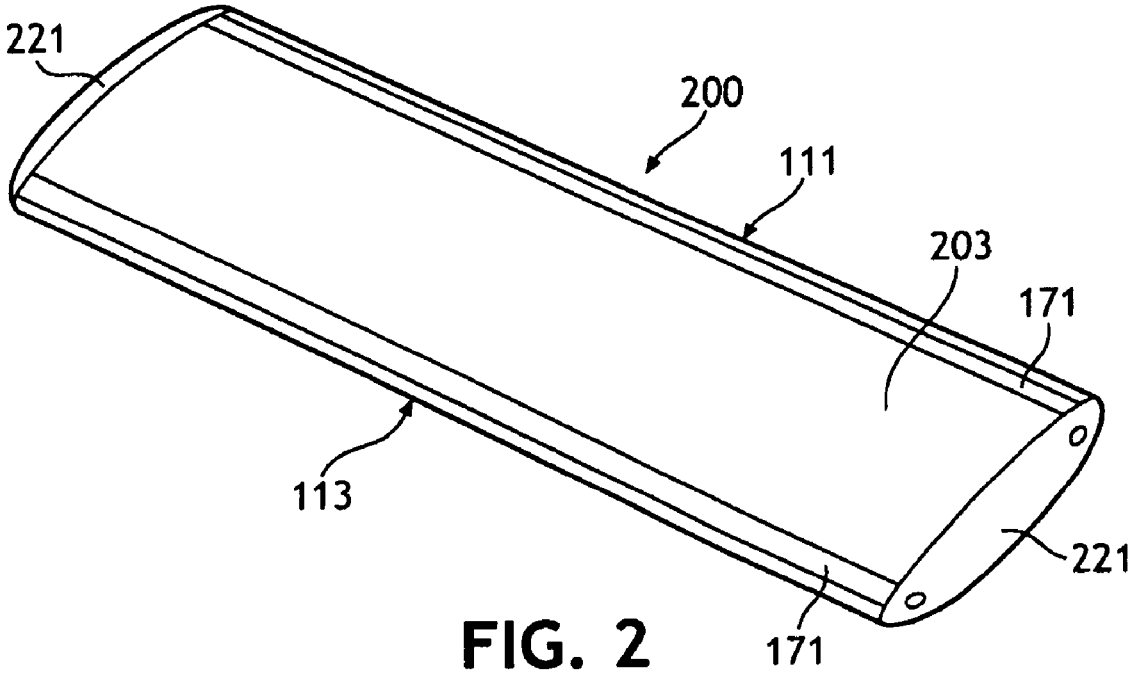
FIG. 2 is a perspective view of a lower substrate support surface of the mop head of FIG. 1, showing the fastener channels on the lower substrate support surface.

As shown in FIGS. 1 and 2, the mop head 200 is generally rectangular in shape with a side-to-side width (the distance between the end edges 115 of the mop head 200) greater than its front-to-back depth (the distance between the front edge 111 and the back edge 113 of the mop head 200). However, the mop head 200 may be any size and shape, symmetrical or asymmetrical that is desired for the particular cleaning needs being addressed. Generally, the mop head 200 may have a side-to-side width of between about 10 inches (254 mm) and about 72 inches (1.8 m) and a front-to-back depth of between about 4 inches (102 mm) and about 16 inches (406 mm), though other sizes are possible. By way of non-limiting example, a mop head 200 intended for commercial use may have a width of about 48 inches (1.2 m) and a depth of about 12 inches (305 mm), while a mop head 200 intended for domestic use may have a width of about 10 inches (254 mm) and a depth of about 6 inches (152 mm). The dimensions of the mop head 200 may be any width and depth that is desired to meet the particular cleaning application.

As illustrated in FIGS. 1 and 2, the lower substrate support surface 203, the upper surface 205, and the end caps 221 are slightly convexly curved between the front edge 111 and the back edge 113 of the mop head 200. Resultantly, the cross-sectional profile of the mop head 200 is generally oblate in shape, however other shapes, symmetrical and asymmetrical, are possible. Thus the thickness of the mop head 200 may vary between the front and back of the mop head 200. Generally, the mop head 200 may have a thickness between about 0.5 inches (12.2 mm) and about 2 inches (50.8 mm) in the center and be thinner at both the front edge 111 and back edge 113, though other sizes and cross-sectional profiles are possible.

The lower substrate support surface 203 may be made from any material that meets the needs of the particular mop head 200. For example, the lower substrate support surface 203 may be desired for commercial applications may utilize a heavier and/or stronger material, while a lighter material may be desired for home applications. Other considerations may include, but are not limited to, weight, durability, compatibility with the cleaning substrate(s) to be used, compatibility with chemicals and substances the surface 203 may come in contact, appearance, ease of cleaning, colors available, disposability, and the like. Typically, the lower substrate support surface 203 may be made of a metal or plastic. More particularly, the lower substrate support surface 203 may be made of aluminum, stainless steel, ABS-plastic, or the like. One skilled in the art would see how such variables could be balanced to produce the lower substrate support surface 203.

Typically, as shown in FIGS. 1 and 5, the mop head 200 may also include an upper surface 205. Such an upper surface 205 may be separate surface mated to the lower substrate support surface 203, may be the opposite size of the lower substrate support surface 203, or may be one surface of a singular tubular shape, opposite and in opposition to the lower substrate support surface 203 (as is shown in FIGS. 1 and 5). As such, the upper surface 205 may be made of the same material as the lower substrate support surface 203 or may a made of a different material. One skilled in the art would see how the same variables balance in the construction of the lower substrate support surface 203 could be balanced for the upper surface 205.

As illustrated in FIGS. 1, 2, 4, 5, and 7, the mop head 200 of the present invention may also include a pair of end caps 221 coupled to either end edge 115 of the mop head 200. The end caps 221 may be desirable to keep the fastener strips 181 within any fastener channels 171 extending from the end edge 115 of the mop head 200. The end caps 221 are desirably configured to be releaseably coupled to the end edge 115 such that the end cap 221 may be removed from the end edge 115 when a fastener strip 181 is to be removed or inserted into the fastener channel 171, and then re-coupled to the end edge 115. As shown in FIG. 7, the end cap 221 may include an end cap grip 225 by which the user may grasp the end cap 221 when removing the end cap 221 from or replacing the end cap 221 on to the mop head 200.

The end caps 221 may be cooperatively shaped to easily couple with the lower substrate support surface 203, and the upper surface 205. As shown in FIGS. 1, 2, 4, 5 and 7, the end caps 221 may have an edge that is convexly curved to match the curve of the lower substrate support surface 203. The end cap 221 may be coupled to the mop head 200 by any method or means that would allow the end cap 221 to removed and replaced in order to insert fastener strips 181, while remaining securely in place on the mop head 200 when the mop head 200 is in use.

As shown in FIG. 7, the end cap 221 may be secured to the mop head 200 with an end cap fastener 227 the works cooperatively with a coupler on the mop head 200. Additionally, a cross-member plug 223 may be included on the end cap 221 to work cooperatively with a cross-member 211. Alternatively, the end cap 221 may be fastened to the mop head 200 by friction fit into the end edge 115 of the mop head 200. Other types of fastening methods and fasteners are known and could be used to releaseably couple the end caps 221 to the mop head 200.

Figure 8A:
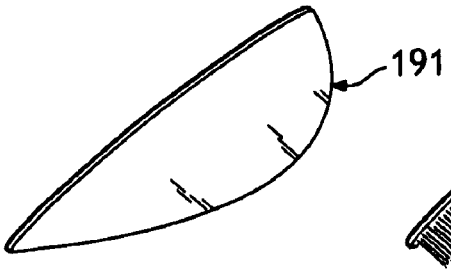
FIG. 8A is a perspective view of a rounded end cap that may be used with the mop head of FIG. 1.
Figure 8B:
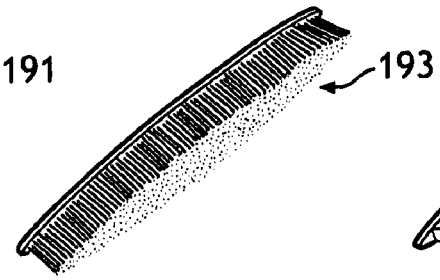
FIG. 8B is a perspective view of a brush end cap that may be used with the mop head of FIG. 1.
Figure 8C:
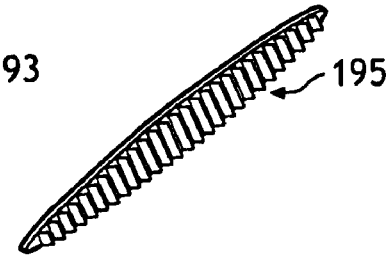
FIG. 8C is a perspective view of a scrubber end cap that may be used with the mop head of FIG. 1.

Additionally, the end cap 221 may provide additional functionality to the mop head 200. As shown in FIGS. 8A, 8B and 8C, various shapes, tools or other items may be included with the end cap 221. In the example of FIG. 8A, the end cap 221 may include a rounded end cap 191 that may help prevent the mop head 200 from scraping walls or other surfaces while using the mop. In the example of FIG. 8B, the end cap 221 may include a brush end cap 193. In the example of FIG. 6C, the fixed end cap 221 may include a scrubbing edged end cap 195 having ridges made of a scrubbing material (e.g., rubber, plastic, sponge). Such examples are not intended to be limiting; one skilled in the art could see how other items could be incorporated into an end cap 221 to add functionality to the mop head 200.

As discussed above, the lower substrate support surface 203 and the end caps 221 may be convexly curved from the front edge 111 to the back edge 113 of the mop head 200. Traditional dry dust mops, disposable cleaning substrate mops, and sponge mops typically have a flat surface that contacts the surface to be cleaned (i.e., a floor). Such a flat-contacting surface maximizes the contact of the mop head or substrate with the floor, however, dust, dirt and debris tends to pile up at the edges of such mops, leaving the central portion of the mop or substrate unused. By providing a slight convex curve to the lower substrate support surface 203 of the present invention, a greater percentage of the entire cleaning substrate surface may be used.

The mop head 200 of the present invention is intended to be used with a disposable cleaning substrate 83. Such cleaning substrates are widely available and well understood. Typically such substrates may be woven, nonwoven, laminates, composites, or combinations thereof, and may be made from natural fibers, synthetic fibers, or combinations thereof. By way of non-limiting examples, the disposable cleaning substrate may be a spunbonded polypropylene material, a knitted polyester substrate, a microfiber substrate made with a polyester/polyamide yarn, a stabilized open-cell thermoplastic foam laminate, a hydroentangled nonwoven composite material, a sponge substrate, or other such substrates as may be desired for particular cleaning needs.

Additionally, such cleaning substrates may be provided as a dry substrate or as a saturated substrate. The cleaning substrate may include additional substances such as cleansers, disinfectants, sanitizers, fragrances, or the like. The disposable cleaning substrate may also be electric treated to impart a static electric charge to the material to attract dust to the charged substrate. Similarly, the disposable cleaning substrate may be made from particular materials (such as rubber, spunbonded polypropylene, spunlace fabrics, or combinations thereof) that may develop such a static electric charge during it use on particular surfaces.

Figure 3:
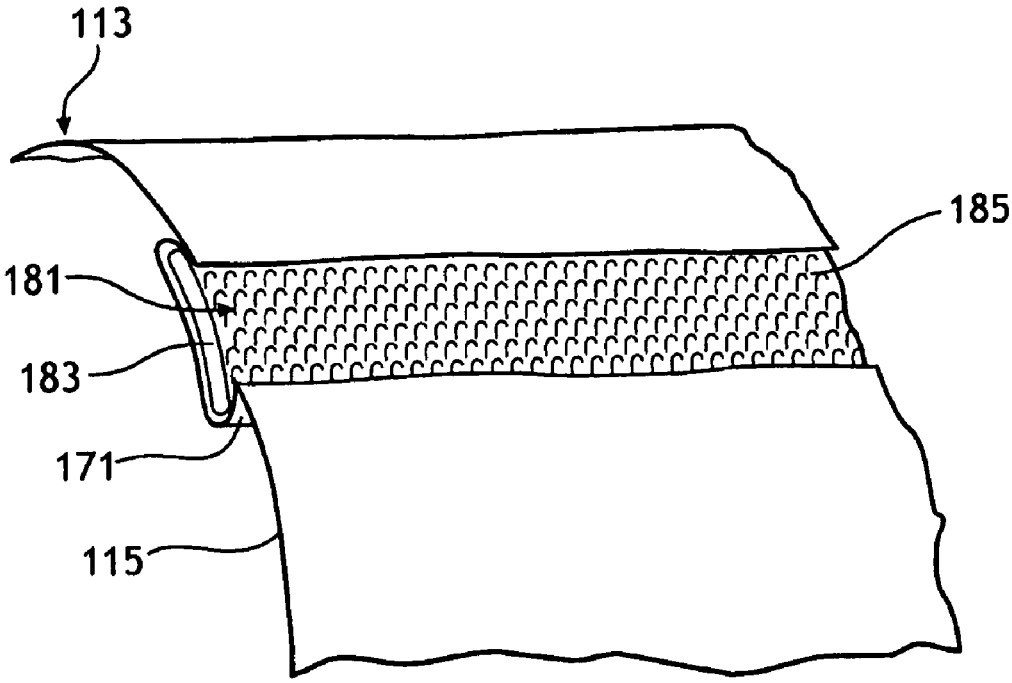
FIG. 3 is a partial perspective view of the lower substrate support surface of the mop head of FIG. 1, showing the fastener channel and a fastener strip.
Figure 4:
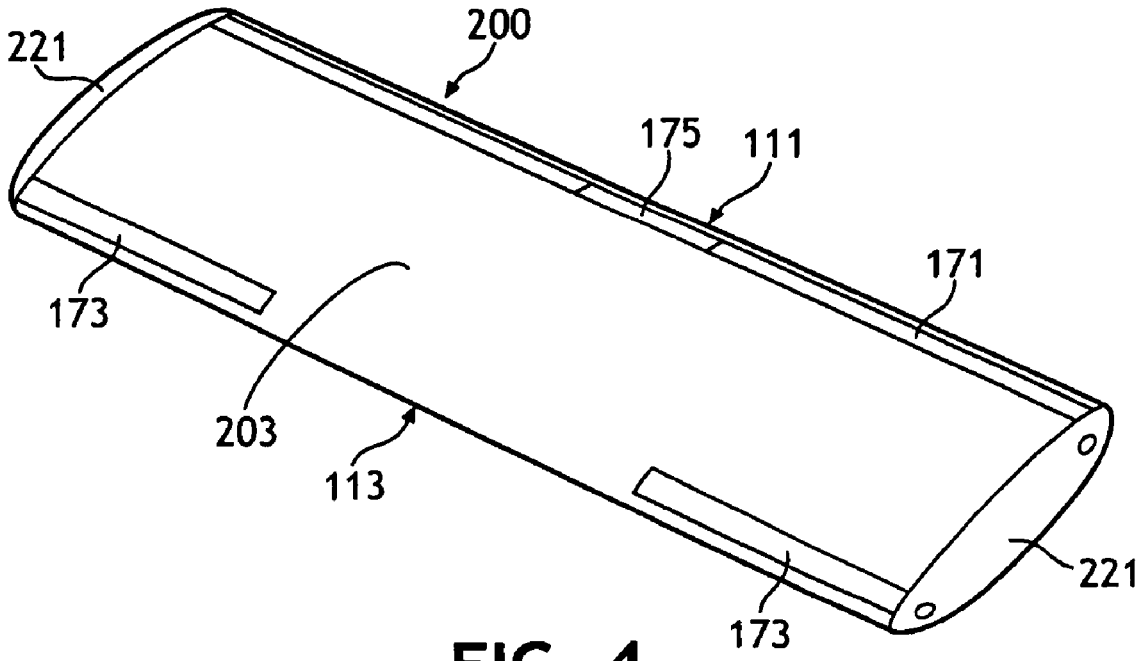
FIG. 4 is a perspective view of lower substrate support surface of the mop head of FIG. 1, showing another fastener channel configuration.

FIGS. 2, 3 and 4 illustrate the fastener channels 171 that may be included on the mop head 200 of the present invention. The fastener channels 171 are preferably associated with the lower substrate support surface 203 to couple a disposable cleaning substrate to the mop head 200. Such fastener channels 171 may extend from the end edges 115 of the mop head 200 so that fastener strips 181 may be easily inserted into the fastener channels 171. As seen in FIG. 2, the fastener channels 171 are preferably located near the front edge 111 and back edge 113 of the lower substrate support surface 203 and extend generally parallel to such edges 111, 113.

As seen in FIG. 3, the fastener channel 171 may be configured is such a way as to securely retain the fastener strip 181 within the channel 171 while allowing the particular fastener 185 of the strip 181 to extend out of the plane of the lower substrate support surface 203 to engage a disposable cleaning substrate. Typically, as shown in FIG. 3, the fastener strip 181 includes a fastener 185 and a backing 183 that secures the fastener 185 to the strip 181. The backing 183 additionally provides some degree of rigidity to the fastener strip 181, such that the fastener strip 181 is not easily pulled out of the fastener channel 171 by any manner other than from the end edge 115 of the mop head 200.

The fastener 185 present on the fastener strip 181 may be any fastener attached to a backing strip 183 that is compatible with the particular cleaning substrate material to be affixed to the mop head 200. The fasteners may be appropriate to directly attach to the substrate material or they may cooperatively couple with a substrate fastener 93 (see FIG. 16) included on the cleaning substrate. Non-limiting examples of such fasteners that may be used with the fastener strips 181 may include independent fasteners such as hook fasteners (as shown in FIG. 4), pressure-sensitive adhesives, and the like, as well as cooperative fasteners such as hook-and-loop fasteners, snaps, magnets, buttons, and the like.

Additionally, different types of fastener strips 181, each utilizing a different type of fastener 185, may be provided to accommodate a variety of different disposable cleaning substrates that the user may want to utilize. For example, a fastener strip having an adhesive fastener may be provided for a cleaning substrate laminate having a film backing layer, a fastener strip having a hook fastener may be provided to accommodate a spunbonded polypropylene cleaning substrate, and a more tenacious hook fastener may be provided on yet another fastener strip to accommodate a microfiber cleaning substrate intended for more vigorous cleaning. One skilled in the art would understand that different types of fasteners work better with different types of substrates and would be able to provide an appropriate variety of fastener strips to accommodate the substrates that a user intends to utilize.

The mop head 200 illustrated in FIG. 2 shows two fastener channels 171 that extend across the entire width of the mop head 200 and a single fastener strip 181 may be present in each of the fastener channels 171. However, other combinations of fastener strips 181 and fastener channels 171 are possible. For example, for the mop head 200 shown in FIG. 2, one type of fastener strip 181 may be used in the fastener channel 171 next to the front edge 111 and a different type of fastener strip 181 may be used in the fastener channel 171 next to the back edge 113 of the mop head 200.

In another example, multiple shorter fastener strips 181 may occupy the same fastener channel. In such instances, the multiple fastener strips 181 may all utilize the same type of fastener or they may include fastener strips 181 utilizing different types of fasteners. Additionally, the multiple fastener strips 181 may be inserted in the fastener channel 171 in such a way that they are in contact with one another or they may be separated by a channel spacer 175 (see FIG. 4) that is inserted into the fastener channel 171 between such fastener strips 181.

FIG. 4 illustrates another possible configuration of fastener channels. As shown, combinations of long fastener channels 171 may be used in combination with partial fastener channels 173. Both FIGS. 2 and 4 illustrate fastener channels 171 near the front and back edges 111, 113 of the mop head 200. However, the fastener channels 171 may also, or may alternatively, be present on the front edge 111, the back edge 113, and/or included on the upper surface 205.

Additionally, one or more secondary attachment structures 207 may be present on the upper surface 205 to assist the fastener channel(s) 171 to retain the disposable cleaning substrate 83 during use of the mop head 200. As shown in FIG. 5, the a secondary attachment structure 207 may be a toothed structure that grasps substrate 83 pushed into its teeth. Other secondary attachment structures 207 are possible and may include one or more different types of attachment structures. The secondary attachment structure 207 may be another fastener channel 171 including a fastener strip 181. Other non-limiting examples of such attachment structures 207 may include pressure sensitive adhesives, clips, screws, clamps, hook fasteners, or other such fasteners as are well known.

One skilled in the art would be able to understand that various combinations of fastener channel 171 configurations (including the position, length and number of such channels), fastener strips 181 (including length, fastener types and number of such strips), and secondary attachment structures 207 (including types, position, and number of such structures) could be configured to couple a particular disposable cleaning substrate 83 to the mop head 200. It is also understood how alternate configurations would be appropriate for other types of cleaning substrates.

A cleaning system including such a mop head 200 may be provided to the user to meet their varied cleaning needs. The user could be supplied with a plurality of disposable cleaning substrates including different types of substrates that may be appropriate for different cleaning needs. Additionally, the user could be supplied with a variety of fastener strips of different types and sizes that are configured to work with the variety of disposable cleaning substrates supplied. To help the user determine the best substrates for their particular cleaning needs, instructions could also be provided to the user. The instruction may also provide the user with best fastener strip or combination of fastener strips to be used for a particular substrate.

Additionally, the each of the plurality of disposable cleaning substrates and each of the fastener strips may include indicia that would help differentiate between the various substrates, differentiate between the various substrates, help match fastener strips with the appropriate cleaning substrates, or other messages that are desired to be conveyed to the user.

Such indicia may be any word(s), numeral(s), line(s), symbol(s), picture(s), color(s) and/or combination(s) thereof, that convey the desired message. By way of non-limiting example, cleaning substrates and the fastener strips that work best with those substrates may include matching symbols or may be the same color. Instructions may also be included to help the user understand the various indicia used and/or help them match specific substrates, fastener strips, or characteristic traits with specific indicia.

The mop head 200 of the present invention may be included as part of a mop system that also includes a handle configured to be coupled to the head mount 161. Such a handle may be a traditional mop stick, as are well known, having a conventional threaded tip that screws into the head mount 161 or some other similar common coupling mechanism. However, it is preferred that the handle of the mop system be a quick-release handle 10 that allows the user to disengage the handle 10 from the mop head 200 without having to bend over, reposition the mop, or otherwise come in close contact with the potentially dirty mop head 200.

Referring to FIGS. 9 to 13 in general, such a quick-release handle 10 may include an elongated shaft 12 having two opposite ends; a proximal end 16 and a distal end 18. The proximal end 16 is proximate to the mop head 200 to which the handle 10 is to be attached. The distal end 18 is distal to the proximal end 16 and proximate to the user. The proximal end 16 includes the quick-release coupling assembly 20 that will cooperate with and couple the handle 10 to a mop head 200. The proximal end 16 is also considered as the attachment end of the handle 10 and the terms "proximal end" and "attachment end may be used interchangeably.

Generally, the distal end 18 will have a grip 41 by which the user may grasp the handle 10. The distal end 18 is also considered the grip end of the handle 10 and the terms "distal end" and "grip end" may be used interchangeably. Additionally, the distal end 18 accommodates the button actuator 45 which the user depresses to release the coupling assembly 20 from any mop head 200 that may be coupled with the proximal end 16 of the handle 10. Thus, the user can release a mop head 200 from the handle 10 by manipulating the distal end 18 rather than repositioning the handle, bending over, or going anywhere near the potentially dirty proximal end 16 of the tool.

Figure 9:
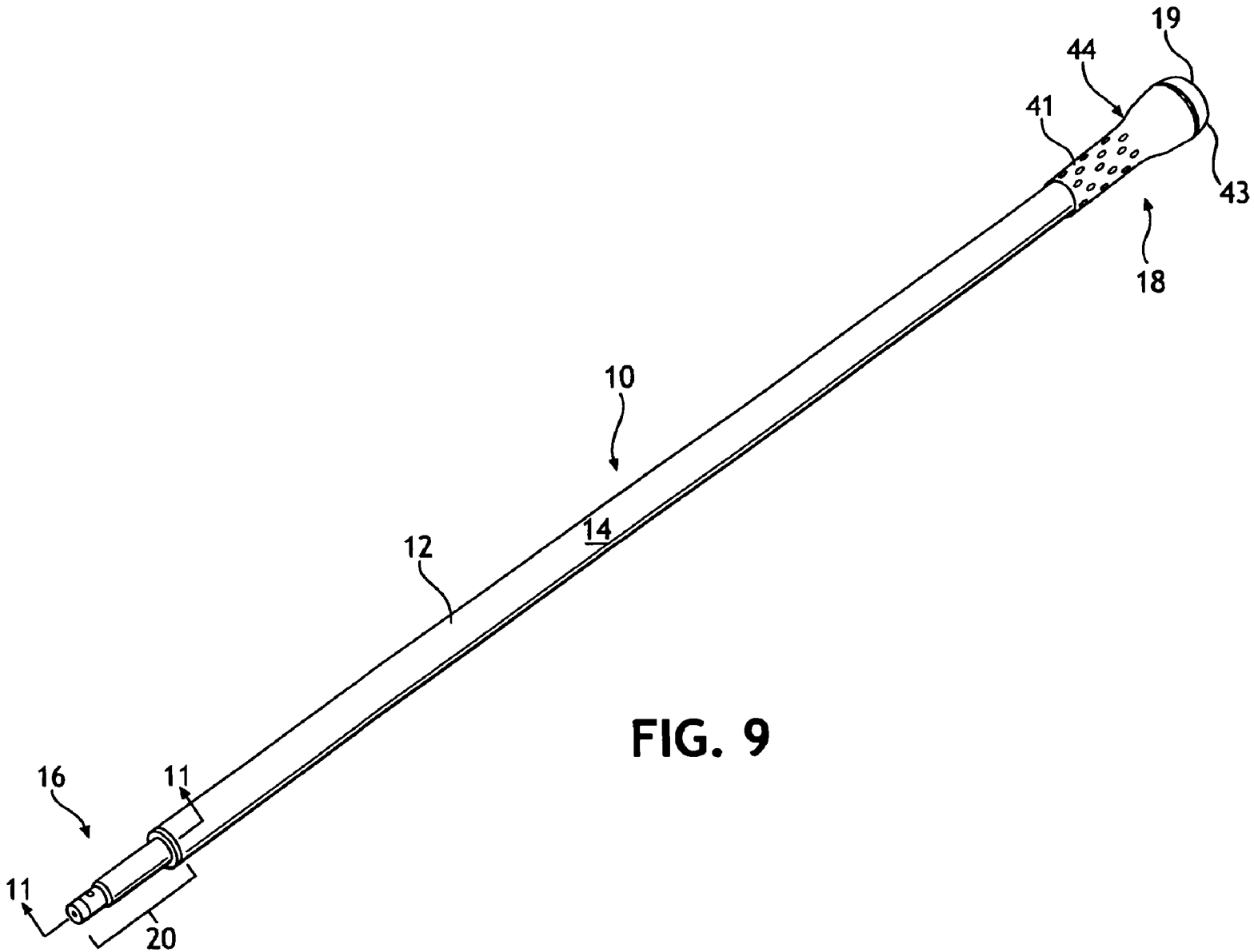
FIG. 9 is a perspective view of a quick-release handle.

The elongated shaft 12 is shown in FIG. 9 as generally cylindrical in shape, having a circular cross-section, as is common for most commonly available long tool handles. As such, the elongated shaft 12 has a single peripheral surface 14. However, other cross-sectional shapes are contemplated and are considered within the scope of the present invention. By way of non-limiting examples, the cross-sectional shape of the elongated shaft 12 may be elliptical, polygonal, or any other symmetrical or asymmetrical shape. Any such alternative cross-sectional shape may provide the elongated shaft 12 with additional peripheral surfaces 14.

Generally, it is desired that the elongated shaft 12 have a length of about 36 inches (0.9 m) to about 72 inches (1.8 m). For a quick-release handle 10 for use with cleaning tool mop heads 200, the elongated shaft will preferably be about 5 feet (1.5 m) in length, similar to the length of commonly available tool handles. The elongated shaft 12 should have an outside diameter suitable for the intended tool mop heads 200 and that is comfortable for use by range of user hand sizes. Typically, the outside diameter will be in the range of about 0.5 inches (12.7 mm) to about 1.5 inches (38.1 mm). Preferably, the outside diameter of the shaft 12 will be similar to that of commonly available handles, 0.75 inches (19.1 mm). Also, the shaft 12 illustrated in FIG. 9 is generally uniform in its diameter from the proximal end 16 to the distal end 18. However, the shaft 12 may alternatively have a non-uniform diameter along its length and may have sections of uniform and non-uniform diameter along its length. The elongated shaft 12 is hollow to accommodate the push rod 31 and the other associated elements of the button actuator 45 and quick-release coupling assembly 20. The hollowed nature of the shaft 12 also decreases the weight of the handle 10 and the amount of material used in making the handle 10. The thickness of the hollow elongated shaft 12 is a function of the materials used to make the shaft 12, the inside diameter required to accommodate the elements to be accommodated within the shaft 12, and the strength and weight desired. One skilled in the art would see how such variables could be balanced to produce the desired shaft 12.

The elongated shaft 12 may be made from any material that meets the needs of the various mop heads 200 with which such a handle 10 is expected to be used. For example, a stronger shaft 12 may be desired for commercial applications while a lighter shaft may be desired for home applications. Other considerations may include, but are not limited to, weight, durability, compatibility with chemicals and substances the handle may come in contact, appearance, ease of cleaning, colors available, disposability, and the like. Typically, the shaft 12 may be made of a metal, plastic, or wood. More particularly, the shaft 12 may be made of aluminum, stainless steel, ABS-plastic, or the like. Again, one skilled in the art would see how such variables could be balanced to produce the desired shaft 12.

Additionally, designs in which the shaft 12 is telescoping, collapsible, and/or foldable are also considered to be within the scope of the present invention.

As discussed above, the quick-release coupling assembly 20 is positioned on the proximal end 16 of the handle 10 and is configured to be coupled with a mop head 200. The coupling assembly 20 may utilize any releasable coupling mechanism, as are well known, to releaseably couple with a mop head 200. By way of non-limiting examples, such a releasable coupling mechanism may utilize a detent ball assembly (as illustrated in FIGS. 10, 11A and 11B), a collet, a chuck, a clamping spring, a bayonet mount, a barbed fastener, a ribbed shank clip fastener, or other such mechanisms or any combination thereof.

The mechanism of the coupling assembly 20 is actuated by the user pressing and releasing the button actuator 45 on the distal end 18 of the shaft 12. The button actuator 45 is operably connected with the coupling assembly 20 by the push rod 31 which extends along the length of the shaft 12, from the button actuator 45 to the coupling assembly 20. As can be seen in the example illustrated in FIGS. 10, 11A, 11B, 12A, 12B and 13, the button actuator 45 is the terminus of the push rod 31 on the distal end 18 of the handle 10. At the proximal end of the push rod 31, a stop collar 33 is fitted around and attached to push rod 31 by a pin 34. A spring 35 around the push rod 31 and compressed between the stop collar 33 and the end wall of the stepped tip 21 of the coupling assembly 20 keeps the push rod 31 biased toward the distal end 18.

Figure 10:
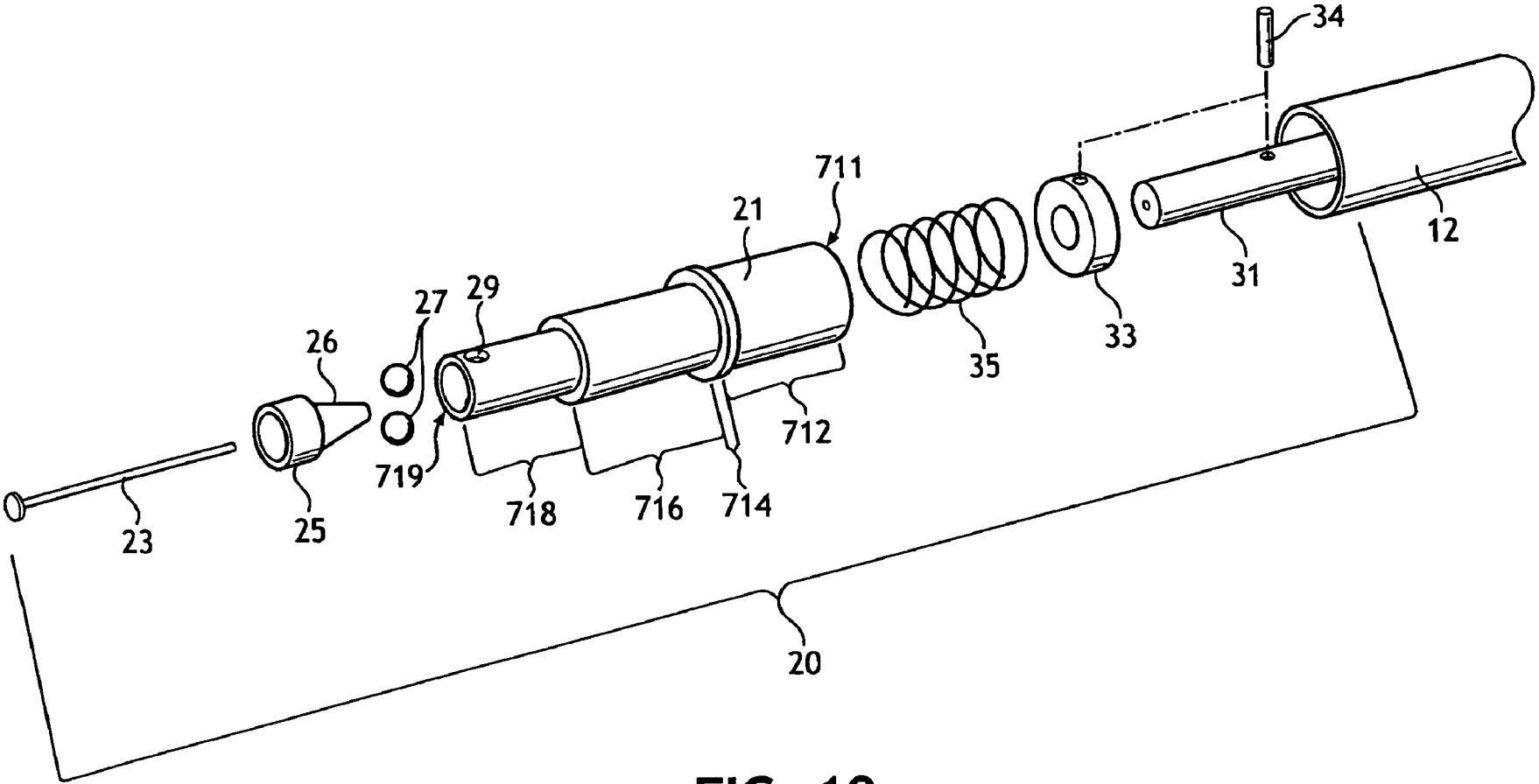
FIG. 10 is a partial perspective exploded view of a quick-release coupling assembly of the handle of FIG. 9.
Figure 11A:
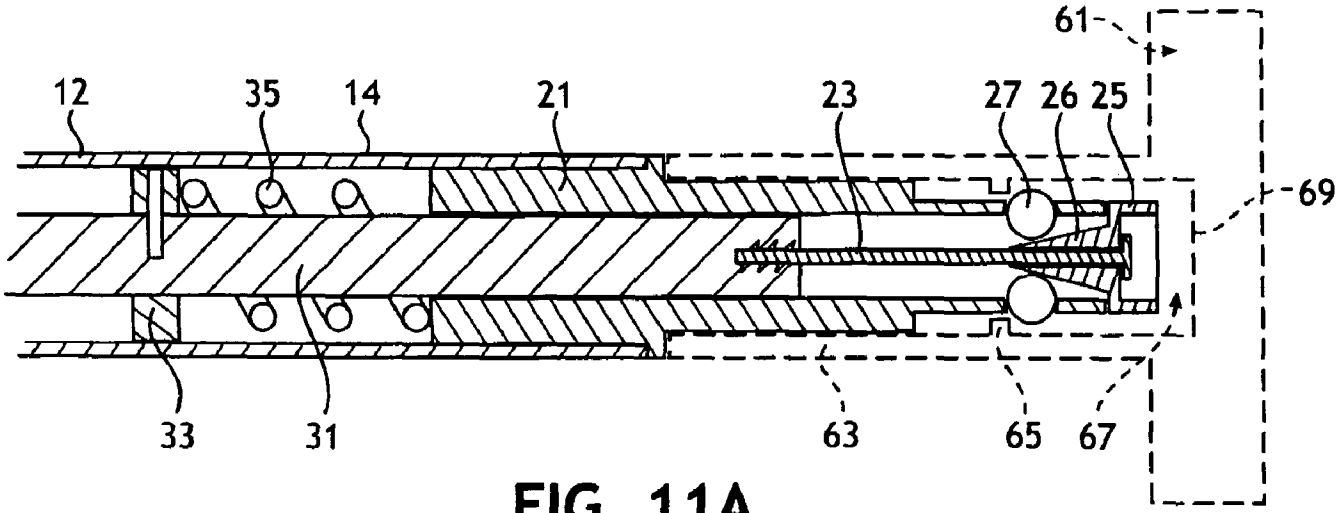
FIG. 11A is a cross-sectional view of a quick-release coupling assembly of the handle of FIG. 9 taken along line 11-11, shown in an engaged configuration with a generic socket mount (illustrated by phantom lines)
Figure 11B:
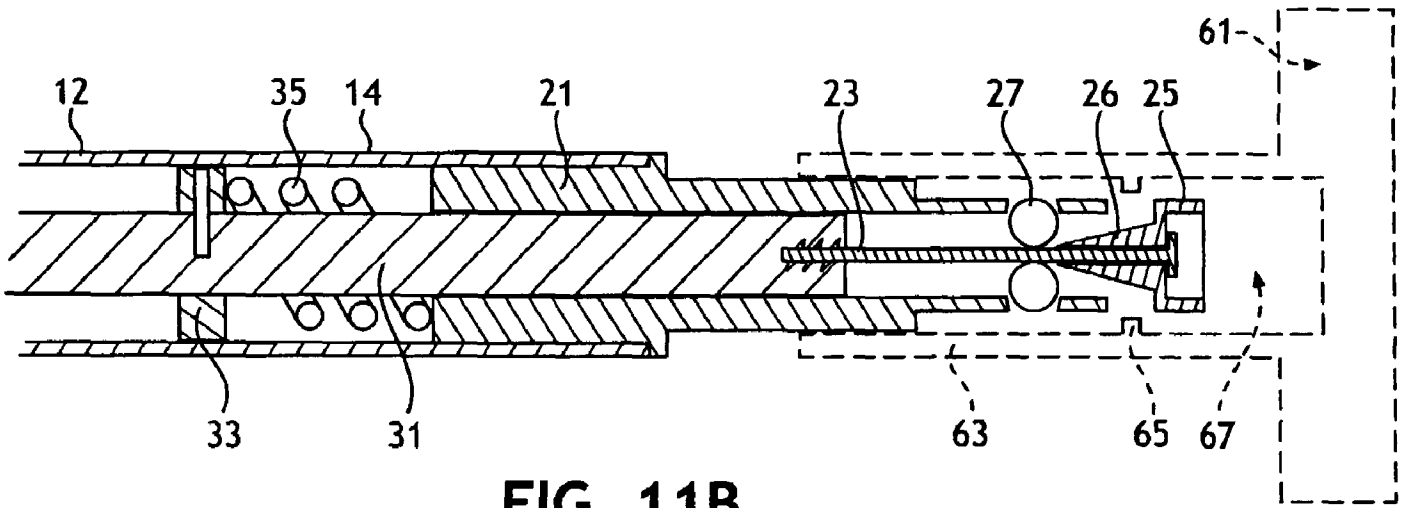
FIG. 11B is a cross-sectional view of the quick-release coupling assembly of the handle of FIG. 9 taken along line 11-11, shown in a release configuration in relation to the generic socket mount (illustrated by phantom lines)

As shown in FIGS. 10, 11A, and 11B, the coupling assembly 20 at the proximal end 16 of the shaft 16 includes a stepped tip 21 having a first end 711 inserted into the proximal end 16 of the shaft 12 and a second end 719 that extends from the end of the shaft 12 and into the socket mount 63 of a head mount 61 of a working head or mop head 200 to which the handle 10 is to be coupled. The stepped tip 21 has an internal longitudinal channel 22 that extends the length of the stepped tip 21, from the first end 711 to the second end 719. The first section 712 of the stepped tip 21 near the first end 711 has a diameter slightly smaller than the inside diameter of the shaft 12 such that the stepped tip 21 may be snuggly fit into the proximal end 16 of the shaft 12. A lip section 714 of the stepped tip 21 seats the stepped tip 21 in the proximal end 16 of the shaft 12 and prevents the stepped tip 21 from being pushed further into the shaft 12.

As illustrated in FIGS. 11A and 11B, once the stepped tip 21 is installed in the shaft 12, the push rod 31 extends into the longitudinal channel 22 of the stepped tip 21. A stop rod 23 extends from the proximal end of the push rod 31 and is attached to the end of the push rod 31. The stop rod 23 extends out of the longitudinal channel 22 at the second end 719 of the stepped tip 21 and is capped by a head portion 25. The head portion 25 has a conical portion 26 that extends around the stop rod 23 inside the longitudinal channel 22. When the stop rod 23 is attached to both the push rod 31 and the head portion 25, the spring 31 that biases the push rod 31 toward the distal end 18 (as discussed above) also pulls the head portion 25 against the second end 719 of the stepped tip 21.

The third section 718 of the stepped tip 21 additionally includes ports 29 that extend from the longitudinal channel 22 to the outer surface of the stepped tip 21. A single detent ball 27 is retained by each port 29 and against the stop rod 23 or the conical portion 26.

When the handle 10 and coupling assembly 20 are in the engaged configuration, such as shown in FIG. 11A, the spring 35 between the stop collar 33 and the first end 711 of the stepped tip 21 biases the push rod 31 toward the distal end 18 of the shaft 12. The stop rod 23 attached to both the head portion 25 and the push rod 31 is subsequently pulled into contact with the second end 719 of the stepped tip 21. The head portion 25 is only pulled to the second end 719 and thus the spring 35 cannot push the push rod 31 further toward the distal end 18 or pull the stop rod further into the stepped tip 21. In such an engaged configuration, the coupling assembly 20 and push rod 31 are held in a neutral state by the spring 35.

As shown in FIG. 11A, when the coupling assembly 20 is in the engaged state, the head portion 25 is pulled to the second end 719 of the stepped tip 21 such that the conical portion 26 of the head 25 is pulled into the longitudinal channel 22. The conical portion 26 engages the detent balls 27 and pushes them into the ports 29 such that the detent balls partially extend outside of the exterior wall of the third section 718 of the stepped tip 21.

FIG. 11B illustrates the release configuration of the handle 10 and coupling assembly 20. When the user depresses the button actuator 45 at the distal end 18, the push rod 31 and the stop collar 33 is pushed toward the proximal end 16 of the shaft 12, compressing the spring 35 between the stop collar 33 and the first end 711 of the stepped tip 21. The stop rod 23, including the head 25, is consequently pushed away from the second end 719 of the stepped tip 21. As the conical portion 26 of the head 25 is pushed toward the second end 719, the detent balls 27 are allowed to fall back into the longitudinal channel 22 and against the stop rod 23. When the user releases the button actuator 45, the spring 35 returns the handle 10 to the engaged, or neutral, configuration as illustrated in FIG. 11A.

To work with the coupling assembly 20, the generic head mount 61 includes a socket mount 63 into which the coupling assembly 20 may be inserted. A retention stop 65 within the socket mount 63 cooperatively engages with the coupling assembly 20 to securely couple the working head and the quick-release handle 10. Such a retention stop 65 may be anything within the socket mount 63 that cooperatively engages the detent balls 27 of the coupling assembly 20. By way of non-limiting examples, the retention stop 65 may be a ring fixed within the socket mount 63 (as shown in FIGS. 11A and 11B), recesses within the wall of the socket mount 63, holes in the socket mount 63 (as shown in FIG. 9), or another configuration which can engage the detent balls 27.

In operation, when the coupling assembly 20 is inserted into the socket mount 63, the stepped tip 21 would proceed from the mouth of the socket recess 67 toward the recess terminus 67. When the coupling assembly 20 is in the engaged (neutral) configuration, the detent ball 27 are pushed out of the ports 29 by the conical portion 26 of the head 25, as discussed above. The inside diameter of the ring used as the retention stop 65 shown in FIGS. 11A and 11B is designed to be slightly larger than the outer diameter of the third portion 718 of the stepped tip 21. Thus, as the stepped tip 21 is inserted into the socket mount 63, the third portion 718 snugly passes into the retention stop 65, but the protruding detent balls 27 will come into contact with the retention stop 65. As the user continues to apply insertion pressure to the stepped tip 21, the detent balls 27 are forced into the ports 29 and push against the conical portion 26 and consequently push the head 25 from the second end 719. Once the stepped tip 21 is pushed farther into the socket mount 63, the detent balls 27 clear the retention stop 65 and are again forced out of the ports 29 by the conical portion 26. The detent balls 27 engage the retention stop 65 as illustrated in the engaged configuration shown in FIG. 11A.

The socket mount 63 includes a socket recess 67 on the recess terminus side of the retention stop 65. Such a recess 67 allows enough room for the head 25 to extend from stepped tip 21 as necessary for the detent balls 27 to drop inside the stepped tip 21 during insertion of the coupling assembly 20 or release of the working head, as discussed above.

The use of a coupling assembly 20 with the detent ball 27 mechanism described and illustrated in FIGS. 10, 11A and 11B, is only one possible coupling assembly 20 that may be used in the handle 10 of the present invention. As discussed above, other coupling mechanisms are contemplated for the coupling assembly 20 to couple the handle 10 with a mop head 200 and operably connect to the button actuator 45 such that the mop head 200 is released from the handle 10 when the button actuator 45 is manipulated.

For increased universality, the socket mount 63 may additionally be threaded from the mouth of the socket mount 63 to the retention stop 65. Such a socket mount 63 could then also accept a standard handle with a thread tip, if the user so desired.

The second section 716 of the stepped tip 21 is designed to have an outside diameter slightly smaller than the inside diameter of the socket mount 63. This ensures that the coupling assembly 20 snuggly fits within the socket mount 63 such that the mop head 200 is securely and solidly held at the end of the handle 10. If the socket mount 63 is threaded, the second section 716 would need to have an outside diameter slightly smaller that the threads. Although not shown, a second spring could be included inside of the socket mount 63, attached to the recess terminus 69. Such a spring would be compressed upon insertion of the coupling assembly 20 into the socket mount 63. When the button actuator 45 was subsequently pressed to release the working head from the handle 10, such a spring would then bias the socket mount 63 off of the coupling assembly 20.

Figure 14A:
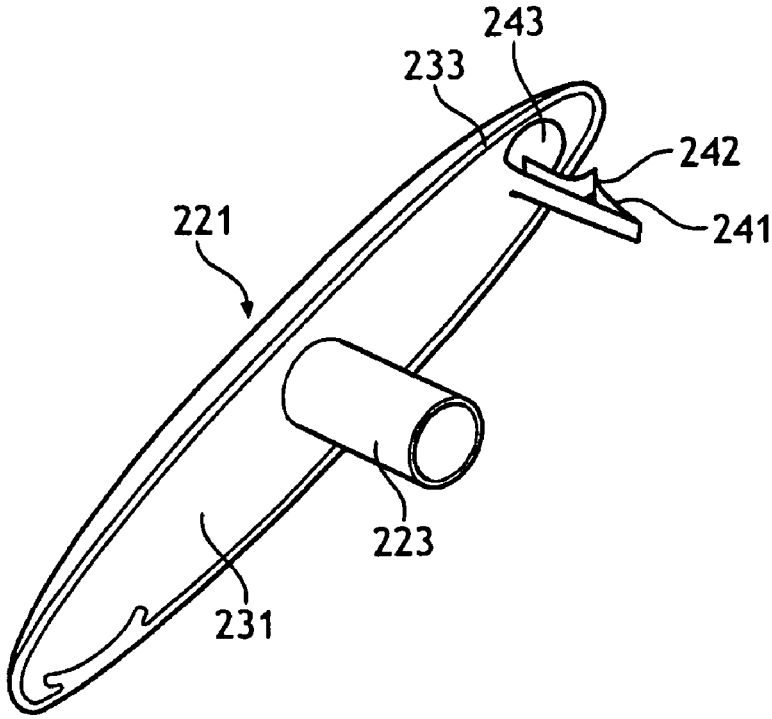
FIG. 14A is a perspective view of the inside surface of an end cap including a barbed fastener.
Figure 14B:
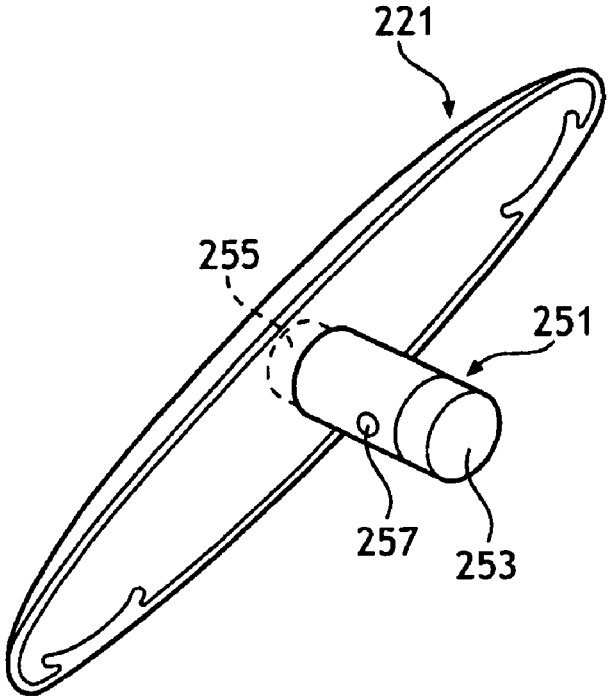
FIG. 14B is a perspective view of the inside surface of an end cap including a quick-release coupling assembly and showing a button (by dotted lines) that actuates the quick-release coupling assembly.

Returning briefly to the end caps 221 of the mop head 200, such end caps 221 may be releaseably coupled to the end edge 115 of the mop head using similar coupling mechanism as discussed for the coupling assembly 20 of the handle 10. FIGS. 14A and 14B, illustrate two non-limiting examples of coupling mechanisms that may be included on the end caps 221. FIG. 14A shows the interior surface 231 of such an end cap 221 including a cross-member plug 223 and a barbed fastener 241. When such a end cap 221 is coupled with the end edge 115 of the mop head 115, the cross-member plug 223 could fit within the cross-member 211 and the barb 242 of the barbed fastener 241 could engage a retention ridge (not shown) present within the mop head 200. When the user wished to release the end cap 221 of FIG. 14A from the mop head 200, a finger hole 243 would allow the user to manipulate and disengage the barbed fastener 241 from the retention ridge.

Similarly, the end cap of FIG. 14B shows the interior surface 231 of an end cap 221 including a cross-member plug 223 and a quick-release coupling assembly 251. The quick-release coupling assembly 251 of the end cap 221 may be the same mechanism as described for coupling assembly 20 of the quick-release handle 10 (as shown in FIGS. 9, 10, 11A and 11B). The quick-release coupling assembly 251 could couple the end cap 221 to the cross-member 211 with the detent balls 257 of the coupling assembly 251 engaging a retention stop or recesses within the end of the cross-member 211. When the user wished to release the end cap 221 of FIG. 14B from the mop head 200, the user could depress a button 255 that actuates a push rod and head 253 assembly to release the detent balls 257 in a manner similar to that discussed in regard for the coupling assembly 20 of the quick-release handle 10.

The coupling mechanisms as described and illustrated by FIGS. 14A and 14B are only two examples of possible coupling mechanism and are not meant to be limiting. Other coupling mechanism utilizing the cross-member 211 and/or other components may be possible to releaseably couple the end caps 221 to the mop head 200.

Additional stability may be added to the connection of the head mount 161 of the mop head 200 and the coupling assembly 20 by the inclusion of a coupler shroud 71 at the proximal end 16 of the shaft 12. As shown generally in FIGS. 5 and 6, the coupler shroud 71 has portions that both protect the exposed coupling assembly 20 from damage and cooperate with the designs of the head mounts 161 to securely couple the mop head 200 and handle 10.

Figure 6:
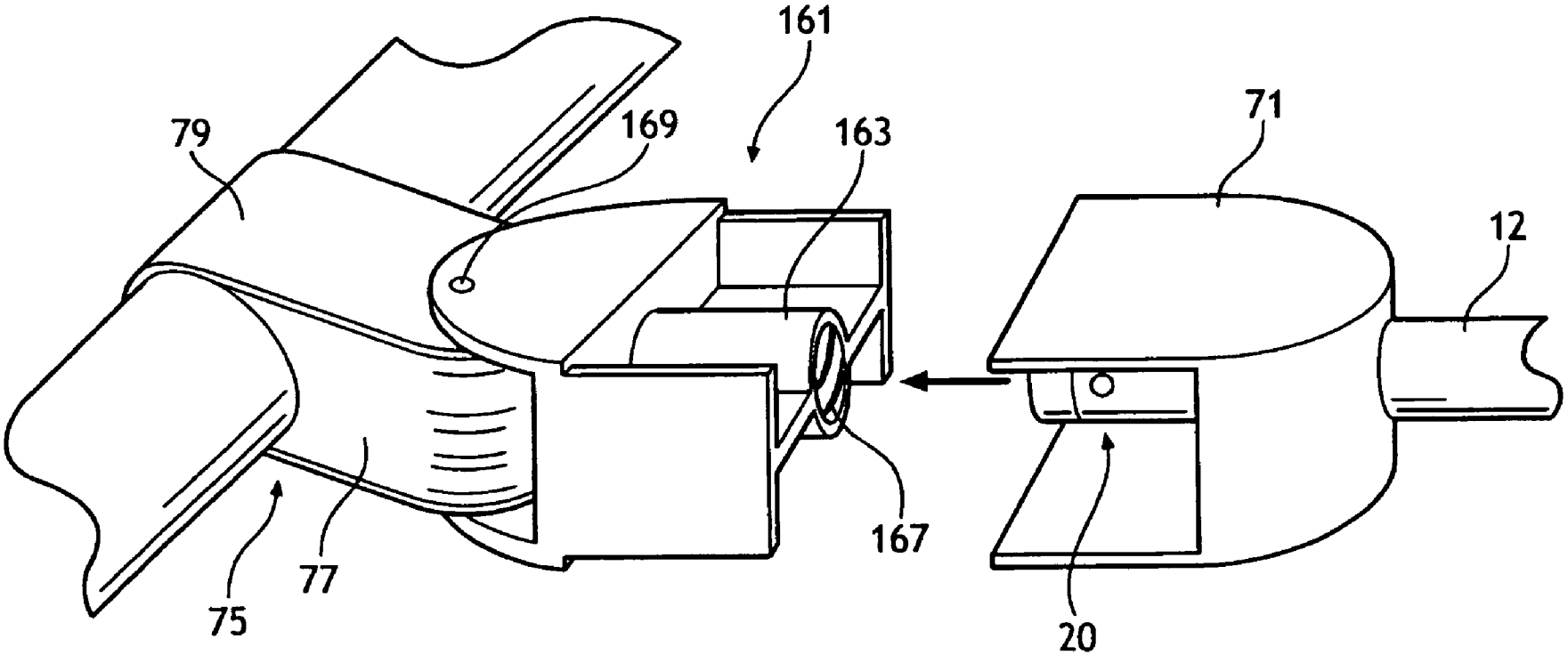
FIG. 6 is a partial perspective view of the mounting head of the mop head of FIG. 1, the mounting head positioned to engage the coupling assembly of the quick-release handle.

An example of a coupler shroud 71 and cooperating head mount 161 is shown in FIGS. 5 and 6. The illustrated coupler shroud 71 and the head mount 161 are cooperatively designed such that coupler shroud 71 fits within the head mount 161 and the heat mount 161 fits within the coupler shroud 71. Such a cooperative design ensures a snug and solid coupling of the mop head 200 attached to the head mount 161 and the handle 10. As such, the mop head 200 would be unable to rotate about the shaft axis. Additionally, such a head mount 161 along with the coupler shroud 71 could help protect the coupling assembly 20 from damage and minimize the contact the coupling assembly 20 has with the outside environment during use.

As shown in FIGS. 1, 5 and 6, additional functionality may be added to a head mount 161 by including a head coupler 75. The head coupler 75 connects the head mount 161 to the cross-member 211 of the mop head 200. The particular head coupler 75 shown in FIGS. 1, 5 and 6 has a coupler bracket 79 that fits around a portion of the cross-member 211. A coupler spacer 77 cooperates with the coupler bracket 79 to hold the coupler bracket 79 against the support shaft 151. A pin 169 through the head mount 161, coupler bracket 79, and the coupler spacer 77 couples the head mount 161 and head coupler 75.

The head coupler 75, illustrated in FIGS. 7 and 8, allows the head coupler 75, the attached head mount 161, and the coupled quick-release handle 10 to rotate about the cross-member 211 and consequently allows the distal end 18 of the handle 10 to move vertically relative to the floor and the mop head 200. Additionally, the head coupler 75 is designed to interact with the head mount 161 such that the head mount 161 and coupled handle 10 may pivot on the pin 169 of the head coupler 75 such that the distal end 18 of the handle 10 may be pivoted from side-to-side, relative to the mop head 200.

Additionally, when the mop heads 200 of FIGS. 1 and 5 include such a head coupler 75, any handle coupled to the head mount 161 may be rotated to either side of mop head 200. Thus, when in use, either the front edge 111 or the back edge 113 of the mop head 500 may act as the leading edge of the mop assembly. This type of mop head 200 configuration along with a convexly curved lower substrate support surface 203 may help maximize the usage of a coupled disposable cleaning substrate.

To aid the user in grasping the handle 10, the distal end 18 may be equipped with a grip 41 and a knob 43. The grip 41 has a slightly larger diameter than the shaft 12 and is preferably made of material, or is otherwise designed, to facilitate grasping of the shaft 12. Additionally, such a grip 41 should be designed to have the necessary durability required for the typical use of such handle 10. For example, the grip 41 may be made of rubber, plastic, metal, or the like. Such materials may be given a texture through processing or through design by the addition of ridges, patterns, or divots to the surface of the grip 41 (as shown in FIGS. 9, 12A and 12B).

The grip 41, as shown in FIGS. 9, 12A, 12B and 13, may additionally have a knob 43 that also provides the user with more comfort than a traditional stick used with common brooms or mops. Generally, such traditional sticks merely have the end rounded off and cause fatigue to the user's hand and often result in blisters or calluses in the palm of the hand after extended use. The small diameter of the end of such traditional sticks causes discomfort and is often difficult for the user to fully grasp.

Figure 12A:
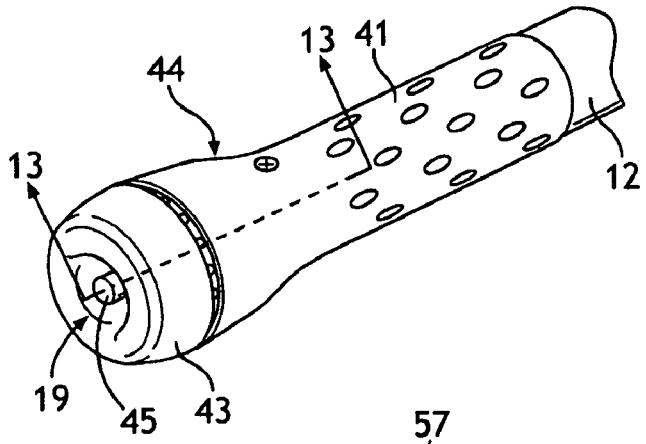
FIG. 12A is a partial perspective view of the distal end of the quick-release handle of FIG. 9 showing a grip, a freely-rotating knob, and a button actuator.
Figure 12B:
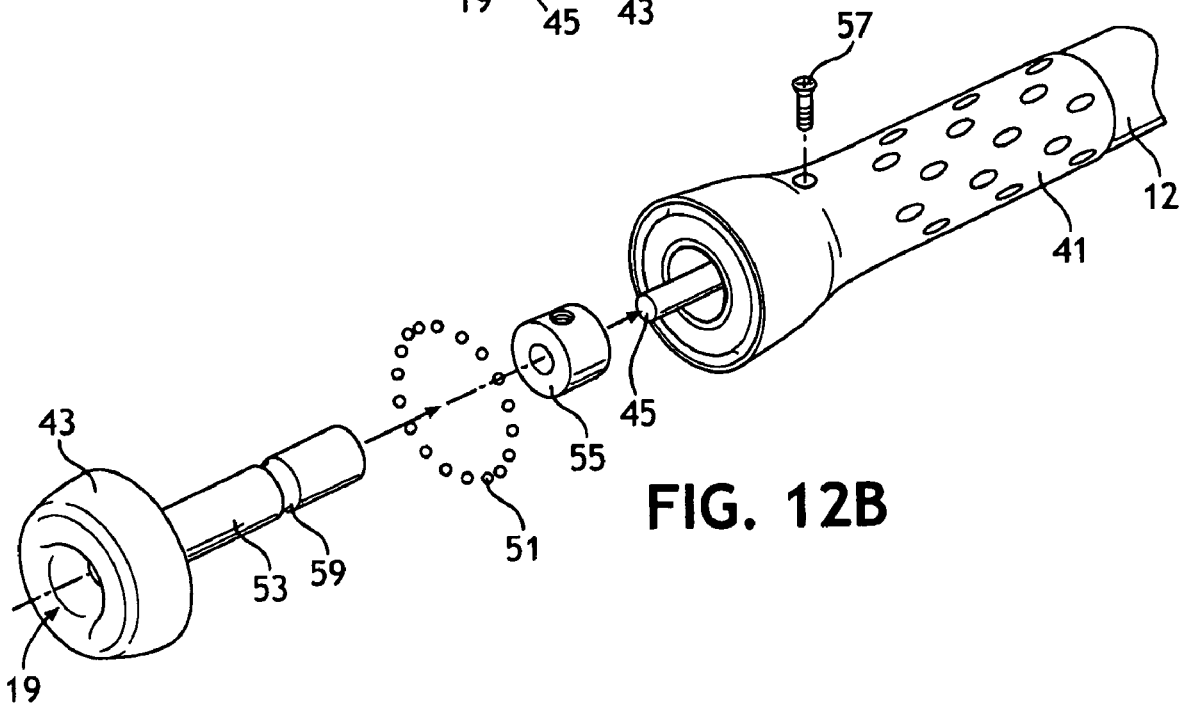
FIG. 12B is a partial perspective exploded view of the distal end of the quick-release handle of FIG. 12A.
Figure 13:
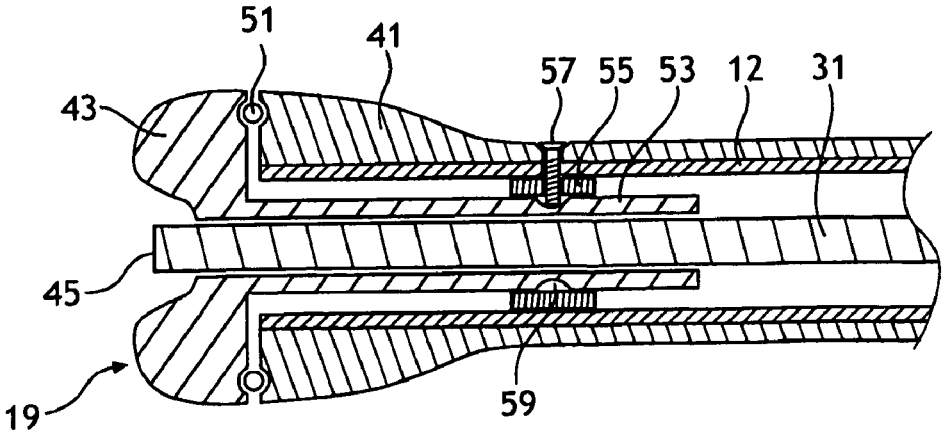
FIG. 13 is a cross-sectional view of the distal end of the quick-release handle of FIG. 12A taken along the line 13-13.

A knob 43 such as shown in FIGS. 12A, 12B and 13, provides the user with a much larger diameter end to the handle 10 compared to traditional sticks. The larger diameter of the knob 43, relative to traditional sticks makes the knob 43 much easier to grasp. By increasing the surface area of the distal end surface 19 of the knob 43, the forces experienced by the user's hand are spread out over a greater surface area than can be achieved by a rounded end of a traditional stick. Such a better distribution of forces result in a reduction in the amount of fatigue the user experience in their hand.

The knob 43 may be formed as a unitary part of the terminus of the grip 41 or it may be an additional part added to the distal end 18 of the shaft 12. The knob 43 shown in FIGS. 12A, 12B and 13 is only intended to be an exemplary shape for such a knob 43; the knob 43 may be any size and shape, symmetrical or asymmetrical, that allows the user to comfortably grasp and utilize the handle 10.

As can be seen in FIGS. 9 and 12A, the shape of the knob 43 is extended to the grip 41 of the distal end 18 of the handle 10. This functional grab area 44 of the knob 43 allows a user to maintain a grip of the knob 43, when the user pushes the handle 10 away from their body. This is particularly useful in mopping when a user will regularly "cast out" a mop and then bring the handle 10 and mop back to themselves.

Additionally, the button actuator 45 is also present at the distal end 18 of the handle 10. As shown in FIGS. 12A and 13, the button actuator 45 is incorporated into the knob 43 and is recessed within the distal end surface 19. As such, the user may grasp the knob 43 during use without unintentionally depressing the button actuator 45 and accidentally releasing the mop head 200. The button actuator 45 shown in FIGS.

12A, 12B, and 13 is merely the terminus of the push rod 31. However, the button actuator 45 may be a separate piece attached or otherwise operably connected to the push rod 31

The knob 43, as shown in FIGS. 12A, 12B and 13, may additionally have the added ability to freely rotate 360-degrees on the terminus of the distal end 18 of the shaft 12. Such a freely-rotating knob 43 would reduce the rubbing and twisting that the user's hand experiences when using traditional sticks. By allowing the knob 43 to freely rotate, the user may maintain a grasp on the knob 43 during regular use of the tool and avoid the fatigue and blisters that often accompanied use of a traditional push broom, mop, or floor duster.

The rotation of the knob 43 may be accomplished with by any type of mechanical bearings, as are well known, that allow the desired 360-degrees of free rotation. By way of non-limiting examples, the rotation may be accomplished with sliding bearings or bushings, rolling-element bearings (such as ball bearings, roller bearings, taper roller bearings), fluid bearings, magnetic bearings, or the like. In the example shown in FIGS. 12A, 12B, and 13, the rotation of the knob 43 is accomplished with a track of ball bearings 51 that are held in place by cooperative recesses in both the end of the grip 41 and in the knob 43. The ball bearings 51 allow the knob 43 to freely-rotate a full 360-degrees about the axis of the shaft 12, on the end of the grip 41.

The assembly of the freely-rotating knob 43 is illustrated in FIGS. 12A, 12B and 13. A shaft sleeve 53 is associated with the knob 43 such that the shaft sleeve 53 fits over the push rod 31 when the knob 43 and associated shaft sleeve 53 are inserted into shaft 12. A knob-connecting collar 55 inserted into the shaft 12 fits around the shaft collar 53. A set screw 57 is inserted from the exterior of the handle 10, through the grip 41, through the shaft 12, and into the knob-connecting collar 55. As such, the set screw 57, holds the knob-connecting collar 55 in place within the interior of the shaft 12. When the knob 43 and associated shaft sleeve 53 are inserted into the shaft 12, the set screw 57 is aligned with a notch 59 circumscribed on the exterior of the shaft sleeve 53. With the set screw 57 in place within the notch 59, the knob 43 is held firmly in place on the terminus of the handle 10 and against the ball bearings 51. As such the knob 43 may freely rotate 360-degrees upon the ball bearings 51, the shaft sleeve 53 is allowed to also freely rotate within the shaft 12, and the knob 43 is kept from being pulled from the end of the handle 10.

Additionally, the shaft sleeve 53 has an interior diameter that allows the push rod 31 to pass through the shaft sleeve 53 such that knob 43 and shaft sleeve 53 may freely rotate about push rod 31. As shown in FIGS. 12A and 13, the button actuator 45 is recessed within the distal end surface 19. When in use, the knob 43 freely rotates about the button actuator 45 and push rod 31 without the risk of the user unintentionally depressing the button actuator 45 or the non-rotating button actuator 45 rubbing on the palm of the user's hand As an added benefit to the mop system of the present invention, the disposable cleaning substrate may be provided in a continuous web format. Such a continuous web format may provide a more conveniently stored than a multitude of individual cleaning substrates. Additionally, when users have more than one width of mop head 200, the continuous web of substrate could be configured to be a selectable-size substrate 85 such that user need only store one continuous web of substrate rather than multiple sizes of individual substrates.

Figure 15:
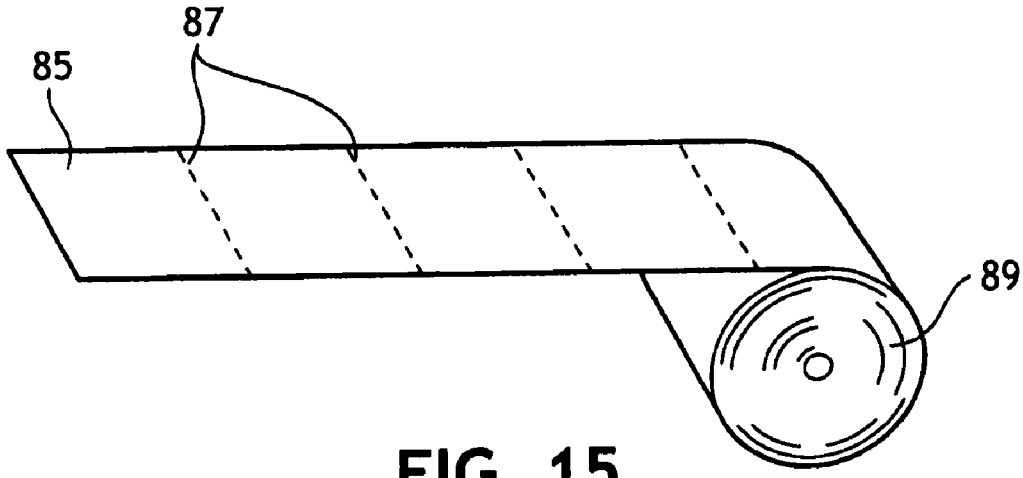
FIG. 15 is a perspective view of a continuous web of selectable-width cleaning substrate in a roll format.

As shown in FIG. 15, the continuous web of selectable-size substrate 85 may have lines of weakness 87 at regular intervals along the length of the web 85. Such lines of weakness 87 may be perforations, scoring, areas of weakened material, or other similar character that allows a portion of the cleaning substrate to be removed from the continuous web of substrate 85. The regular interval between the lines of weakness 87 would be an interval that would balance the needs of various widths of mop heads 200. For example, the system of the present invention may include floor mops having head widths of 12 inches (305 mm), 18 inches (457 mm), 24 inches (610 mm), 36 inches (914 mm), and 48 inches (1.2 m). In such a system, a selectable-size substrate 85 would preferably have lines of weakness 87 at 6-inch (152 mm) intervals. The user would then be able to easily tear off any appropriate length of substrate 85 for the particular width head that they were using.

Figure 16:
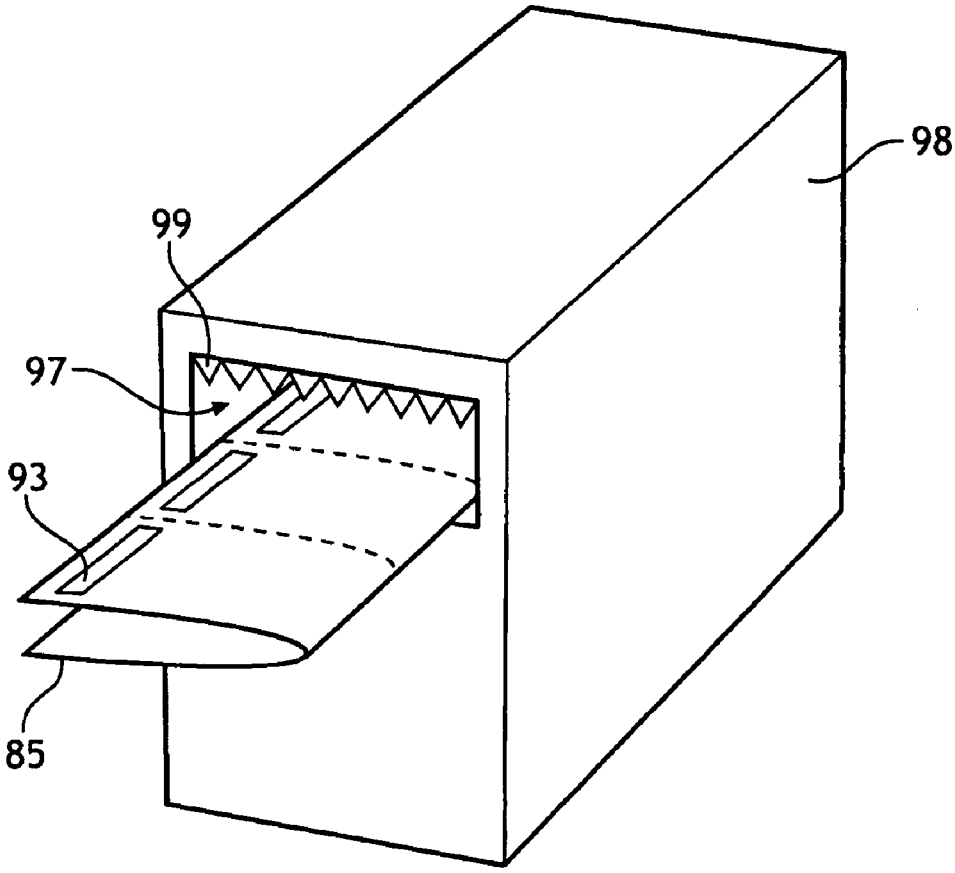
FIG. 16 is a perspective view of a continuous web of selectable-width cleaning substrate and disposed within a container.

Such disposable cleaning substrates may be a single flat sheet as shown in FIG. 15, a folded or two-ply sheet as shown in FIG. 16, a tubular substrate, or other formats that could be provided as a continuous web and as necessary for the various mop heads 200 of the system. As shown in FIG. 16, such substrates may additionally include substrate fasteners 93 that may interact with the particular mop heads 200 to attach the substrate to those mop heads 200.

The selectable-size substrate shown in FIG. 15 is provided in a roll format 89. As such, the roll 89 could be mounted in a roll product dispenser, as are commonly available and widely understood. Such a dispenser could be available on the wall, on a cart, or wherever would be most convenient for the user of the system. Alternatively, the selectable-size substrate 85 may be provided to the user in a container 98, such as shown in FIG. 16. The substrate 85 could be stored and dispensed from the container 98 through a dispensing opening 97 in the container 98. The substrate 85 may be available in the container 98 in any format that is desired. It may be a roll 89, as in FIG. 15, merely piled in the container 98, or may be festooned within the container 98.

Additional functionality could also be added to the container 98. As shown in FIG. 16, the container 98 may have a separator 99 that the user could use to more easily separate the cleaning substrate along the lines of weakness 87. Such containers 98 may also include indicia that would help the user identify the amount or type of substrate contained, instructions on proper use, disposal instructions, or other messages that are desired to be conveyed to the user. Such indicia may be any word(s), numeral(s), line(s), symbol(s), picture(s), color(s) and/or combination(s) thereof, that convey the desired message. Additionally, or alternatively, the container 98 may have additional features such as viewing slots such the user can see the amount of remaining substrate, mounting brackets for mounting the container 98 on a support surface, disposal/recycling features, or other such characteristics that enhance the system and make it easier to use.

It will be appreciated that the foregoing examples and discussion, given for purposes of illustration, are not to be construed as limiting the scope of this invention, which is defined by the following claims and all equivalents thereto.

We claim

1. A mop head assembly adapted for use with a handle and a cleaning substrate, the mop assembly comprising:

a lower substrate support surface comprising a front edge, a back edge and a pair of opposing end edges;

at least one fastener channel associated with the lower substrate support surface, the fastener channel extending from an end edge of the lower substrate support surface; and more than one fastener strip, wherein the more than one fastener strip comprises more than one type of fastener strip, wherein at least one fastener strip is configured to be inserted, contained, and removed from the fastener channel, and is also configured to couple the lower substrate support surface with a cleaning substrate, and wherein the lower substrate support surface is convexly curved between the front edge and the back edge.

2. The assembly of claim 1, wherein the fastener strip comprises a backing and a fastener, the fastener affixed to the backing.

3. The assembly of claim 1, wherein the lower support surface comprises more than one fastener channel.

4. The assembly of claim 1, wherein the more than one fastener strips are present within the same fastener channel.

5. The assembly of claim 1, wherein the lower support surface comprises more than one fastener channel and wherein each fastener strip of the more than one fastener strips is each present in its own fastener channel.

6. The assembly of claim 1, further comprising an end cap releaseably coupled with the mop head assembly at the end edge of the lower substrate support surface.

7. The assembly of claim 6, wherein the end cap comprises a quick-release coupling assembly configured to releaseably couple the end cap with the mop head assembly.

8. The assembly of claim 1, further comprising an upper surface opposing the lower substrate support surface, the upper surface comprising a front edge, a back edge and a pair of opposing end edges.

9. The assembly of claim 8, wherein the upper surface comprises at least one secondary attachment structure.

10. A mop head assembly adapted for use with a handle and a cleaning substrate, the mop assembly comprising:

a lower substrate support surface comprising a front edge, a back edge and a pair of opposing end edges;

a cross-member associated with the lower substrate support surface, the cross-member extending between the opposing end edges of the lower substrate support surface;

at least one fastener channel associated with the lower substrate support surface, the fastener channel extending from an end edge of the lower substrate support surface; and at least one fastener strip, the fastener strip configured to be inserted, contained, and removed from the fastener channel, wherein the fastener strip is configured to couple the lower substrate support surface with a cleaning substrate, and wherein the cross-member is configured such that forces applied to a central portion of the cross-member are distributed along the cross-member toward the end edges of the lower substrate support surface.

11. The assembly of claim 10, further comprising a head mount coupled with the central portion of the cross-member, the head mount configured to releaseably couple the mop head assembly with a mop handle.

12. The assembly of claim 10, wherein the lower support surface comprises more than one fastener channel.

13. The assembly of claim 10, further comprising more than one fastener strip.

14. The assembly of claim 13, wherein the more than one fastener strip comprises more than one type of fastener strip.

15. The assembly of claim 13, wherein the more than one fastener strips are present within the same fastener channel.

16. The assembly of claim 10, wherein the lower substrate support surface is convexly curved between the front edge and the back edge.

17. The assembly of claim 10, further comprising an end cap releaseably coupled with the mop head assembly at the end edge of the lower substrate support surface, wherein the end cap comprises a quick-release coupling assembly configured to releaseably couple the end cap with the mop head assembly.

18. The assembly of claim 10, further comprising an upper surface opposing the lower substrate support surface, the upper surface comprising a front edge, a back edge and a pair of opposing end edges, wherein the upper surface comprises at least one secondary attachment structure, and wherein the secondary attachment structure is associated with the upper surface and extends from an end edge of the upper surface.

19. A mop system for use with a handle, the mop system comprising:

a mop head assembly comprising a lower substrate support surface; and a disposable cleaning substrate coupled with the mop head assembly, wherein the lower substrate support surface comprises a front edge, a back edge and a pair of opposing end edges, wherein the lower substrate support surface is convexly curved between the front edge and the back edge, wherein the mop head assembly comprises at least one fastener channel associated with the lower substrate support surface, the fastener channel extending from an end edge of the lower substrate support surface, wherein the mop head assembly comprises a plurality of fastener strips, wherein the plurality of fastener strips comprises a variety of different types of fastener strips, wherein at least one fastener strip is configured to be inserted, contained, and removed from the fastener channel, and is also configured to couple the lower substrate support surface with a cleaning substrate.

20. The system of claim 19, further comprising a head mount with a socket mount, the socket mount configured to releaseably couple the mop head assembly with a mop handle, and a quick-release mop handle releaseably engaged with the head mount, wherein the quick-release mop handle comprises a proximal end proximate to the mop head and a distal end distal to the mop head; a quick-release coupling assembly positioned on the proximate end of the handle, the quick-release coupling assembly configured to releaseably couple the handle with the head mount; and a button actuator positioned on the distal end of the handle, the button actuator operably connected to the quick-release coupling assembly.

21. The system of claim 19, wherein the disposable cleaning substrate comprises a cooperative fastener that cooperates with the fastener strip to couple the substrate with the mop head assembly.

22. The system of claim 19, wherein the disposable cleaning substrate comprises a continuous web of cleaning substrate, the continuous web comprising lines of weakness at regular intervals such that various widths of disposable cleaning substrate are removable via the lines of weakness.

23. The system of claim 19, further comprising a plurality of cleaning substrates, wherein the plurality of cleaning substrates comprises a variety of different types of cleaning substrates.

* * * * *

UNITED STATES PATENT AND TRADEMARK OFFICE

CERTIFICATE OF CORRECTION

PATENT NO. : 7,650,665 B2
APPLICATION NO. : 11/458106
DATED : January 26, 2010
INVENTOR(S) : Morris et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 246 days.

Signed and Sealed this

Twenty-third Day of November, 2010

David J. Kappos

David J. Kappos
*Director of the United States Patent and Trademark Office*